US007883201B2

(12) United States Patent
Yahiro

(10) Patent No.: US 7,883,201 B2
(45) Date of Patent: Feb. 8, 2011

(54) IMAGE FORMING APPARATUS AND IMAGE FORMING METHOD

(75) Inventor: Yasuko Yahiro, Ashigarakami-gun (JP)

(73) Assignee: Fujifilm Corporation, Tokyo (JP)

( * ) Notice: Subject to any disclaimer, the term of this patent is extended or adjusted under 35 U.S.C. 154(b) by 680 days.

(21) Appl. No.: 11/905,119

(22) Filed: Sep. 27, 2007

(65) Prior Publication Data

US 2008/0079769 A1 Apr. 3, 2008

(30) Foreign Application Priority Data

Sep. 29, 2006 (JP) ..... 2006-269588

(51) Int. Cl.
*B41J 2/01* (2006.01)

(52) U.S. Cl. ..... 347/103

(58) Field of Classification Search ..... 347/103
See application file for complete search history.

(56) References Cited

U.S. PATENT DOCUMENTS

2006/0001722 A1* 1/2006 Stelter et al. ..... 347/103

FOREIGN PATENT DOCUMENTS

JP 2002-370441 A 12/2002

* cited by examiner

*Primary Examiner*—Julian D Huffman
(74) *Attorney, Agent, or Firm*—Birch, Stewart, Kolasch & Birch, LLP

(57) ABSTRACT

An image forming apparatus includes: a conveyance device which conveys an ejection receiving medium; and an ejection head which ejects and deposits droplets of liquid on the ejection receiving medium conveyed by the conveyance device, the deposited droplets of the liquid constituting an image on the ejection receiving medium, wherein the following conditions are satisfied:

$$\gamma_S \geqq \gamma_L; \text{ and}$$

$$d \geqq \sqrt{2} \times l,$$

where $\gamma_S$ is a surface energy of the ejection receiving medium, $\gamma_L$ is a surface energy of the liquid, d is a diameter of each of the droplets of the liquid deposited on the ejection receiving medium, and l is a maximum of a resolution pitch of the image.

10 Claims, 18 Drawing Sheets

FIG.6

| MEDIUM | | FIRST LIQUID (1) $\gamma_L$=29.7mN/m | FIRST LIQUID (2) $\gamma_L$=26.2mN/m | FIRST LIQUID (3) $\gamma_L$=46.0mN/m |
|---|---|---|---|---|
| SILICONE RUBBER | $\gamma_S$=11.4 mN/m | B | B | B |
| FLUORO-RUBBER | $\gamma_S$=29.5 mN/m | B | A | B |
| OHP SHEET | $\gamma_S$=43.2 mN/m | A | A | B |
| HARD POLYVINYLCHLORIDE | $\gamma_S$=47.4 mN/m | A | A | A |
| GLASS | $\gamma_S$=67.6 mN/m | A | A | A |

FIG.9

| | | FIRST LIQUID | | |
|---|---|---|---|---|
| | | (1) | (2) | (3) |
| | $\gamma_L$(mN/m) | 29.7 | 26.2 | 46 |
| SILICONE RUBBER | $\gamma_S$(mN/m) | 11.4 | 11.4 | 11.4 |
| | d(m) | $2.5\times10^{-5}$ | $3.6\times10^{-5}$ | $2.3\times10^{-5}$ |
| | $2\gamma_S\sqrt{(d/2)^2-(\ell/2)^2}-d\gamma_L$ | $-5.9\times10^{-4}$ | $-6.1\times10^{-4}$ | $-9.6\times10^{-4}$ |
| | POSITION DISPLACEMENT | B | B | B |
| | COALESCENCE CAHRACTERISTICS | B | B | B |
| FLUORO-RUBBER | $\gamma_S$(mN/m) | 29.5 | 29.5 | 29.5 |
| | d(m) | $3.2\times10^{-5}$ | $6.5\times10^{-5}$ | $2.7\times10^{-5}$ |
| | $2\gamma_S\sqrt{(d/2)^2-(\ell/2)^2}-d\gamma_L$ | $-2.4\times10^{-4}$ | $1.1\times10^{-4}$ | $-7.5\times10^{-4}$ |
| | POSITION DISPLACEMENT | B | A | B |
| | COALESCENCE CAHRACTERISTICS | B | A | B |
| OHP SHEET | $\gamma_S$(mN/m) | 43.2 | 43.2 | 43.2 |
| | d(m) | $5.8\times10^{-5}$ | $6.7\times10^{-5}$ | $3.5\times10^{-5}$ |
| | $2\gamma_S\sqrt{(d/2)^2-(\ell/2)^2}-d\gamma_L$ | $6.1\times10^{-4}$ | $9.9\times10^{-4}$ | $-4.1\times10^{-4}$ |
| | POSITION DISPLACEMENT | A | A | B |
| | COALESCENCE CAHRACTERISTICS | A | A | B |
| PVC | $\gamma_S$(mN/m) | 47.4 | 47.4 | 47.4 |
| | d(m) | $3.2\times10^{-5}$ | $7.5\times10^{-5}$ | $2.6\times10^{-5}$ |
| | $2\gamma_S\sqrt{(d/2)^2-(\ell/2)^2}-d\gamma_L$ | $1.7\times10^{-4}$ | $1.4\times10^{-3}$ | $-4.8\times10^{-4}$ |
| | POSITION DISPLACEMENT | A | A | A |
| | COALESCENCE CAHRACTERISTICS | A | A | B |
| GLASS | $\gamma_S$(mN/m) | 67.6 | 67.6 | 67.6 |
| | d(m) | $6.1\times10^{-5}$ | $6.9\times10^{-5}$ | $5.8\times10^{-5}$ |
| | $2\gamma_S\sqrt{(d/2)^2-(\ell/2)^2}-d\gamma_L$ | $9.0\times10^{-4}$ | $1.3\times10^{-3}$ | $-1.1\times10^{-4}$ |
| | POSITION DISPLACEMENT | A | A | A |
| | COALESCENCE CAHRACTERISTICS | A | A | B |

$d<\ell$ $d=\ell\sqrt{2}$ $d=\ell$ $d=2\ell$

FIG.13

| | FIRST LIQUID (1) | | FIRST LIQUID (2) | |
|---|---|---|---|---|
| | IMAGE FORMING CHARACTERISTICS OF FIRST LIQUID | IMAGE FORMING CHARACTERISTICS OF SECOMD LIQUID | IMAGE FORMING CHARACTERISTICS OF FIRST LIQUID | IMAGE FORMING CHARACTERISTICS OF SECOMD LIQUID |
| SILICONE RUBBER | B | B | B | B |
| FLUORO-RUBBER | B | B | A | A |
| OHP SHEET | A | A | A | A |
| GLASS | A | A | A | A |

IMAGE FORMING APPARATUS AND IMAGE FORMING METHOD

BACKGROUND OF THE INVENTION

1. Field of the Invention

The present invention relates to an image forming apparatus and an image forming method, and more particularly to an inkjet recording apparatus and an inkjet recording method whereby a solid image can be formed by applying liquid droplets on an ejection receiving medium to a uniform film thickness.

2. Description of the Related Art

Japanese Patent Application Publication No. 2002-370441 discloses an intermediate transfer type of inkjet recording method in which, before applying a first ink containing coloring material, and the like, a second ink which is reactive with respect to the first ink and which forms an aggregate of the first ink, is deposited on an intermediate transfer body, and the first ink is then deposited on the intermediate transfer body by means of an inkjet head. In this method, as a result of the reaction of the second ink with the first ink, the first ink increases in viscosity, and a print image which is free of ink bleeding or feathering is thereby formed on the intermediate transfer body, whereupon the print image on the intermediate transfer body is transferred to a recording medium.

In this method, the deposited volume of the second ink is less than the deposited volume of the first ink, and therefore it is possible to obtain a uniform image in a solid image region, and it is possible to prevent problems, such as flowing of the ink or color mixing.

However, in the case of the invention described in Japanese Patent Application Publication No. 2002-370441, if it is sought to form a uniform film of the second ink on the intermediate transfer body by applying a small volume of second ink, then the droplets of the second liquid are liable to move and combine with each other on the intermediate transfer body. This is because the intermediate transfer body on which the droplets of the second ink are to be deposited, typically has relatively high liquid-repelling properties for the purpose of achieving excellent transfer characteristics. Consequently, it is extremely difficult to apply the film to a uniform thickness.

SUMMARY OF THE INVENTION

The present invention has been contrived in view of these circumstances, an object thereof being to provide an image forming apparatus and an image forming method whereby solid image regions can be formed by applying (depositing) liquid droplets to a uniform film thickness, without the occurrence of positional displacement of the deposited droplets, even in the case of a recording medium or an intermediate transfer body having high liquid-repelling properties.

In order to attain the aforementioned object, the present invention is directed to an image forming apparatus including: a conveyance device which conveys an ejection receiving medium; and an ejection head which ejects and deposits droplets of liquid on the ejection receiving medium conveyed by the conveyance device, the deposited droplets of the liquid constituting an image on the ejection receiving medium, wherein the following conditions are satisfied:

$$\gamma_S \geqq \gamma_L; \text{ and}$$

$$d \geqq \sqrt{2} \times l,$$

where $\gamma_S$ is a surface energy of the ejection receiving medium, $\gamma_L$ is a surface energy of the liquid, d is a diameter of each of the droplets of the liquid deposited on the ejection receiving medium, and l is a maximum of a resolution pitch of the image.

According to this aspect of the present invention, it is possible to deposit liquid droplets on the ejection receiving medium without the occurrence of the positional displacement of the deposited droplets, even in the case of using an ejection receiving medium having high liquid-repelling properties by setting conditions of $\gamma_S \geqq \gamma_L$. Moreover, it is possible to prevent the occurrence of gaps due to the low liquid droplet volume, by setting conditions of $d \geqq \sqrt{2} \times l$. It is therefore possible to form a film of liquid having a uniform thickness on the ejection receiving medium with a little amount of the liquid, even if the ejection receiving medium has high liquid-repelling properties.

Here, "ejection receiving medium" indicates a medium on which an image is recorded by means of the ejection head (this medium may also be called a print medium, image formation medium, image receiving medium, or the like). This term includes various types of media, irrespective of material and size, such as continuous paper, cut paper, sealed paper, resin sheets, such as OHP sheets, film, cloth, and the like.

Preferably, conditions of $$2 \times \gamma_S \times \sqrt{\left(\frac{d}{2}\right)^2 - \left(\frac{l}{2}\right)^2} \geq d \times \gamma_L$$

are satisfied.

According to this aspect of the present invention, since there is, furthermore, no displacement in the positions of the deposited liquid droplets even after the droplets have joined together, then it is possible reliably to deposit droplets without gaps and to form a film having a uniform film thickness on the ejection receiving medium with a little amount of the liquid, even when the ejection receiving medium has high liquid-repelling properties.

In order to attain the aforementioned object, the present invention is also directed to an image forming apparatus including: a conveyance device which conveys an ejection receiving medium; a first ejection head which ejects and deposits droplets of a first liquid on the ejection receiving medium conveyed by the conveyance device; and a second ejection head which ejects and deposits droplets of a second liquid on the ejection receiving medium on which the first liquid has been deposited, the deposited droplets of the first liquid and the deposited droplets of the second liquid constituting an image on the ejection receiving medium, wherein the following conditions are satisfied:

$$\gamma_S \geqq \gamma_{L1}; \text{ and}$$

$$d_1 \geqq \sqrt{2} \times l,$$

where $\gamma_S$ is a surface energy of the ejection receiving medium, $\gamma_{L1}$ is a surface energy of the first liquid, $d_1$ is a diameter of each of the droplets of the first liquid deposited on the ejection receiving medium, and l is a maximum of a resolution pitch of the image.

According to this aspect of the present invention, it is possible to deposit the droplets of the first liquid on the ejection receiving medium without the occurrence of the positional displacement of the deposited droplets of the first liquid, even in the case of using an ejection receiving medium having high liquid-repelling properties by setting conditions of $\gamma_S \geqq \gamma_{L1}$. Moreover, it is possible to prevent the occurrence of gaps due to the low liquid droplet volume, by setting conditions of $d_1 \geqq \sqrt{2} \times l$. It is therefore possible to form a film of the first liquid having a uniform thickness on the ejection receiving medium with a little amount of the first liquid, even if the ejection receiving medium has high liquid-repelling properties.

Therefore, in a case (a case of two-liquid system) where two liquid (i.e., the first and second liquids) are deposited on the ejection receiving medium, even when using an ejection receiving medium having high liquid-repelling properties, it is possible to deposit droplets of the first liquid on the ejection receiving medium at a uniform film thickness, without gaps, by means of a little amount of the first liquid, and consequently, when droplets of the second liquid are deposited after the first liquid has been deposited, it is possible to deposit the droplets of the second liquid also to a uniform film thickness, without the occurrence of the positional displacement of the deposited second liquid, by means of a small liquid droplet volume.

Preferably, conditions of $$2 \times \gamma_S \times \sqrt{\left(\frac{d_1}{2}\right)^2 - \left(\frac{l}{2}\right)^2} \geq d_1 \times \gamma_{L1}$$

are satisfied.

According to this aspect of the present invention, since there is, furthermore, no displacement in the positions of the deposited liquid droplets even after the droplets of the first liquid have joined together, then it is possible reliably to deposit droplets of the first liquid to a uniform film thickness, without gaps, by means of a small liquid droplet volume, even in the case of using an ejection receiving body having high liquid-repelling properties.

Preferably, the first liquid enhances recording characteristics of the second liquid.

According to this aspect of the present invention, it is possible to obtain a good image having high image resolution. For the first liquid enhancing the recording properties of the second liquid, it is possible to use a liquid which prevents bleeding of the second liquid on the recording medium, or mixing between droplets of the second liquid. It is especially effective to use for the recording properties enhancing liquid a liquid having reactive properties, which has the action of increasing the viscosity of the second liquid or which has the action of aggregating the solvent-insoluble material inside the second liquid. The recording properties enhancing liquid (first liquid) is deposited and a film thereof is formed to a uniform thickness on the ejection receiving medium. The second liquid thus reacts reliably with the recording properties enhancing liquid on the ejection receiving medium, thereby making it possible to obtain a good image which is free of bleeding or mixing.

Preferably, the ejection receiving medium is an intermediate transfer body; and the image formed on the intermediate transfer body is transferred to a recording medium.

According to this aspect of the present invention, it is possible to deposit droplets and to form a film thereof to a uniform thickness with a little amount of the liquid, even when using an intermediate transfer body having high liquid-repelling properties which is suitable for use due to its good image separation characteristics.

Preferably, the surface energy $\gamma_S$ of the ejection receiving medium is not less than 20 mN/m and not greater than 50 mN/m.

According to this aspect of the present invention, it is possible to stabilize the liquid ejection from the ejection head. At the same time, even when using an ejection receiving medium having high liquid-repelling properties, it is possible reliably to deposit liquid droplets and to form a film thereof to a uniform thickness without gaps, by means of a small liquid droplet volume.

Preferably, the first liquid contains a solvent-insoluble material which enhances fixing characteristics of the image on the ejection receiving medium.

According to this aspect of the present invention, the fixing characteristics of the solid image on the ejection receiving medium are improved.

In order to attain the aforementioned object, the present invention is also directed to an image forming method of forming an image on an ejection receiving medium, including the step of ejecting and depositing droplets of liquid on the ejection receiving medium while the ejection receiving medium is conveyed, the deposited droplets of the liquid constituting the image on the ejection receiving medium, wherein the following conditions are satisfied:

$\gamma_S \geqq \gamma_L$; and $d \geqq \sqrt{2} \times l$, where $\gamma_S$ is a surface energy of the ejection receiving medium, $\gamma_L$ is a surface energy of the liquid, d is a diameter of each of the droplets of the liquid deposited on the ejection receiving medium, and l is a maximum of a resolution pitch of the image.

According to this aspect of the present invention, it is possible to deposit liquid droplets on the ejection receiving medium without the occurrence of the positional displacement of the deposited droplets, even in the case of using an ejection receiving medium having high liquid-repelling properties by setting conditions of $\gamma_S \geqq \gamma_L$. Moreover, it is possible to prevent the occurrence of gaps due to the low liquid droplet volume, by setting conditions of $d \geqq \sqrt{2} \times l$. It is therefore possible to form a film of liquid having a uniform thickness on the ejection receiving medium with a little amount of the liquid, even if the ejection receiving medium has high liquid-repelling properties.

In order to attain the aforementioned object, the present invention is also directed to an image forming method of forming an image on an ejection receiving medium, including the steps of: ejecting and depositing droplets of a first liquid on the ejection receiving medium while the ejection receiving medium is conveyed; and then ejecting and depositing droplets of a second liquid on the ejection receiving medium while the ejection receiving medium is conveyed, the deposited droplets of the first liquid and the deposited droplets of the second liquid constituting the image on the ejection receiving medium, wherein the following conditions are satisfied:

$\gamma_S \geqq \gamma_{L1}$; and $d_1 \geqq \sqrt{2} \times l$, where $\gamma_S$ is a surface energy of the ejection receiving medium, $\gamma_{L1}$ is a surface energy of the first liquid, $d_1$ is a diameter of each of the droplets of the first liquid deposited on the ejection receiving medium, and l is a maximum of a resolution pitch of the image.

According to this aspect of the present invention, it is possible to deposit the droplets of the first liquid on the ejection receiving medium without the occurrence of the positional displacement of the deposited droplets of the first liquid, even in the case of using an ejection receiving medium having high liquid-repelling properties by setting conditions of $\gamma_S \geqq \gamma_{L1}$. Moreover, it is possible to prevent the occurrence of gaps due to the low liquid droplet volume, by setting conditions of $d_1 \geqq \sqrt{2} \times l$. It is therefore possible to form a film of the first liquid having a uniform thickness on the ejection receiving medium with a little amount of the first liquid, even if the ejection receiving medium has high liquid-repelling properties.

In the image forming apparatus and image forming method according to the present invention, even in the case of an ejection receiving medium having high liquid-repelling properties, it is possible to form a solid image by depositing liquid to a uniform film thickness, without the occurrence of positional displacement of the deposited liquid droplets.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 6 is a diagram showing evaluation results relating to the occurrence of the position displacement in the deposited droplets when the type of ejection receiving medium and the surface energy of the first liquid are varied;

FIG. 9 shows the results of visual evaluation of the droplet joining characteristics;

FIG. 13 is a diagram showing the results of visual evaluation relating to the image forming characteristics of the first liquid, the image forming characteristics of the second liquid, and transfer characteristics of the second liquid;

DETAILED DESCRIPTION OF THE PREFERRED EMBODIMENTS

Overview of Inkjet Recording Apparatus

Figure 1:
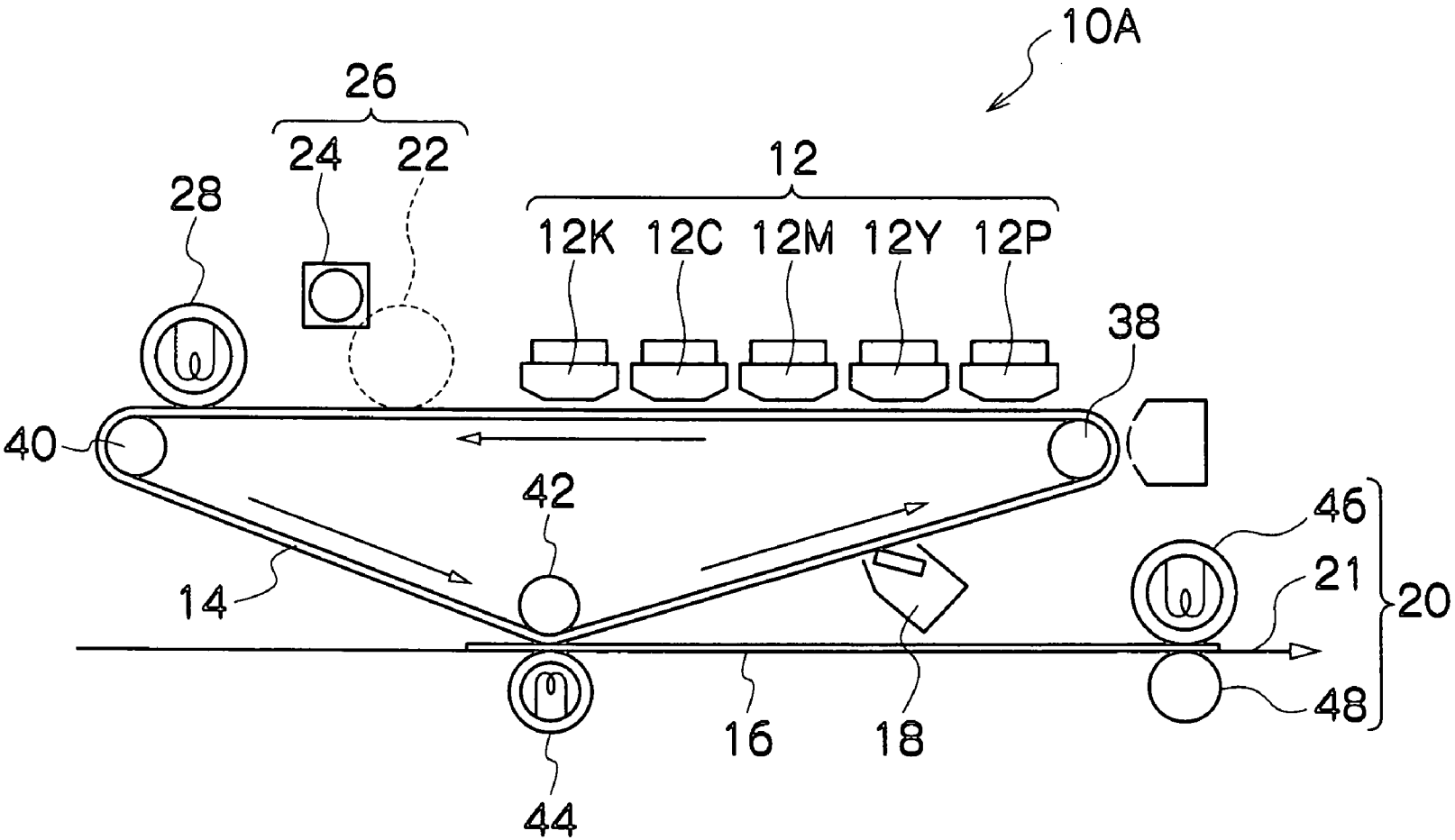
FIG. 1 is a general schematic drawing of an inkjet recording apparatus of intermediate transfer type which forms an image forming apparatus according to an embodiment of the present invention.

Firstly, an overview of an inkjet recording apparatus of intermediate transfer type which forms an image forming apparatus according to an embodiment of the present invention will be described. FIG. 1 is a general schematic drawing of an inkjet recording apparatus 10A of intermediate transfer type. The inkjet recording apparatus 10A is principally constituted of an intermediate transfer body, a first liquid application device (corresponding to a first ejection head), a second liquid application device (corresponding to a second ejection head), a transfer device, a conveyance device, and the like.

As shown in FIG. 1, a print unit 12 includes a plurality of inkjet heads (hereinafter, called "heads") 12P, and 12Y, 12M, 12C and 12K which are provided to correspond respectively to a treatment liquid (P) forming a first liquid, and respective inks of yellow (Y), magenta (M), cyan (C) and black (K) forming second liquids. The print unit 12 corresponds to the first ejection head (ink jet head 12P) and the second ejection head (ink jet heads 12Y, 12M, 12C and 12K).

The intermediate transfer body 14 has an endless shape and is spanned between rollers 38 and 40 which form a conveyance device and a transfer pressurization roller 42. Further, provided is a conveyance unit 20 which is disposed facing the intermediate transfer body 14 and conveys a recording paper 16 while keeping the recording paper 16 flat. In the transfer device, the intermediate transfer body 14 and the recording paper 16 are sandwiched between two transfer pressurization rollers 42 and 44.

The conveyance unit 20 includes a belt 21, and the belt 21 is sandwiched between the transfer pressurization rollers 42 and 44 or between fixing pressurization rollers 46 and 48. The recording paper 16 is held on the belt 21 of the conveyance unit 20 and is conveyed from left to right in FIG. 1. Thereupon, the recording paper 16 is heated by the heating function of the fixing pressurization roller 46 and the image formed on the conveyance recording paper 16 is thereby fixed.

In the inkjet recording apparatus 10A, the treatment liquid (first liquid) containing an aggregating agent is ejected from the head 12P while the intermediate transfer body 14 is conveyed, and the ink liquids (second liquids) containing coloring materials of different colors are ejected respectively from the heads 12Y, 12M, 12C and 12K, thereby forming a mixed liquid of the treatment liquid and each of the ink liquids on the intermediate transfer body 14. Thereupon, a coloring material aggregate is generated in this mixed liquid by subjecting the coloring material to the aggregation reaction caused by the aggregating agent contained in the treatment liquid, and a color image is formed on the intermediate transfer body 14 by means of this coloring material aggregate. Thereupon, the liquid portion of the mixed liquid is removed by a solvent removal unit 26, and the aggregate of the coloring material on the intermediate transfer body 14 is transferred to the recording paper 16 conveyed by the conveyance unit 20, whereby a color image can be formed on the recording paper 16.

Figure 2:
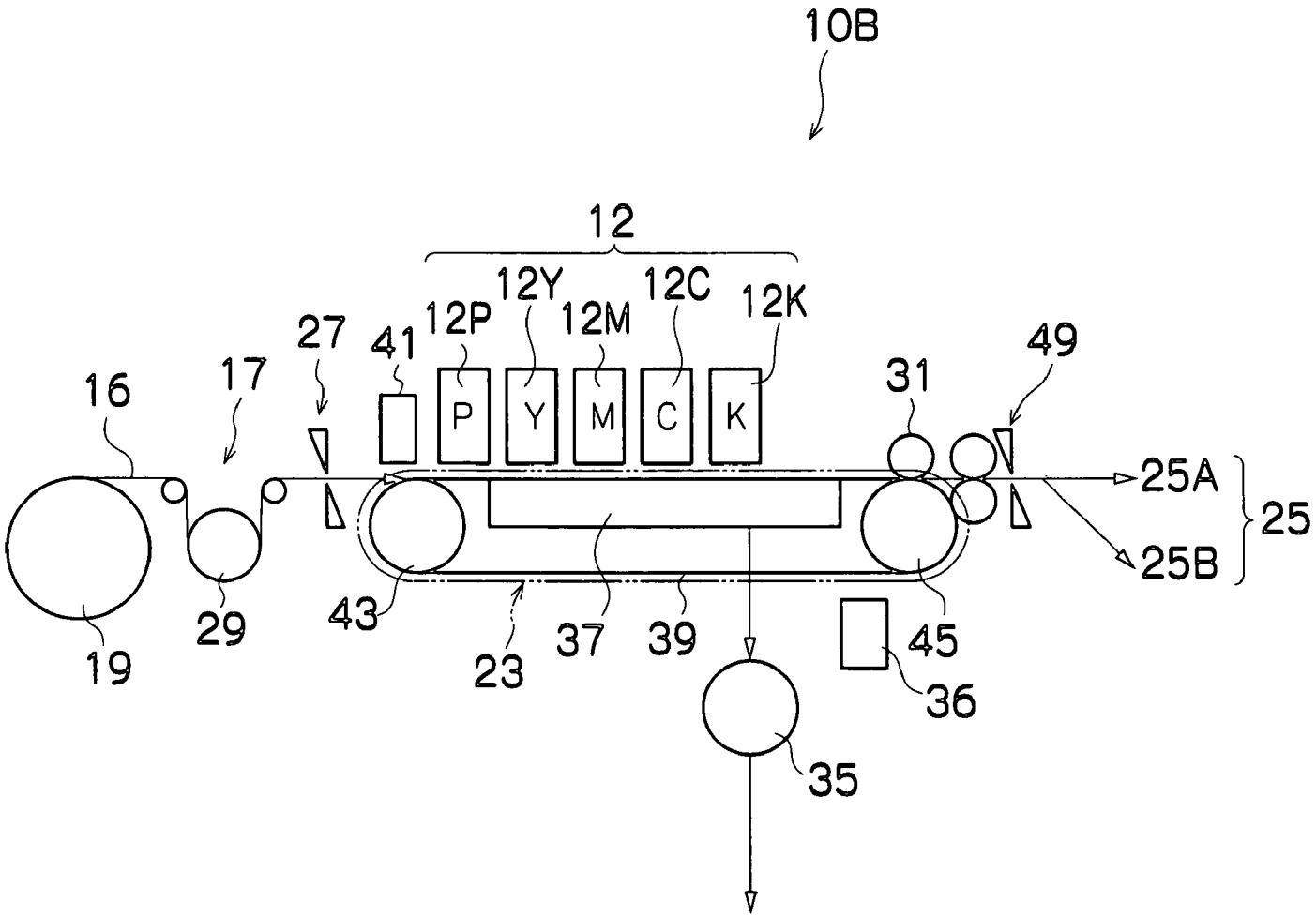
FIG. 2 is a general schematic drawing of an inkjet recording apparatus of direct printing type which forms an image forming apparatus according to an embodiment of the present invention.

Next, an overview of an inkjet recording apparatus of direct printing type which forms an image forming apparatus according to another embodiment of the present invention will be described. FIG. 2 is a general schematic drawing of an inkjet recording apparatus 10B of direct printing type according to an embodiment of the present embodiment.

As shown in FIG. 2, in this inkjet recording apparatus 10B, the print unit 12 and the like are the same as those of the intermediate transfer type of inkjet recording apparatus 10A described above, but the inkjet recording apparatus 10B is different from the inkjet recording apparatus 10A in that rather than having the intermediate transfer body 14, it includes a belt conveyance unit 23 which conveys the recording paper 16 while keeping the recording paper 16 flat, this belt conveyance unit 23 being disposed facing the nozzle face (ink ejection face) of the print unit 12.

In the inkjet recording apparatus 10B, the treatment liquid (first liquid) containing the aggregating agent is ejected from the head 12P while the recording paper 16 is conveyed by means of the belt conveyance unit 23, and the ink liquids (second liquids) containing coloring materials of different colors are ejected respectively from the heads 12Y, 12M, 12C and 12K, thereby forming a mixed liquid of the treatment liquid and each of the ink liquids on the recording paper 16. Subsequently, the liquid portion of the mixed liquid is removed by means of a solvent removal unit 31, and a color image can be formed on the recording paper 16.

A further detailed description of the general composition of the inkjet recording apparatus is given later.

Description of Conditions for Applying Liquid

Next, the conditions for forming a solid image on a non-permeable type of recording medium or on an intermediate transfer body having high liquid-repelling properties (properties whereby the substance (in this case, intermediate transfer body) lacks affinity with a liquid), which is one of the characteristic features of the present invention, will be described.

Figure 3:
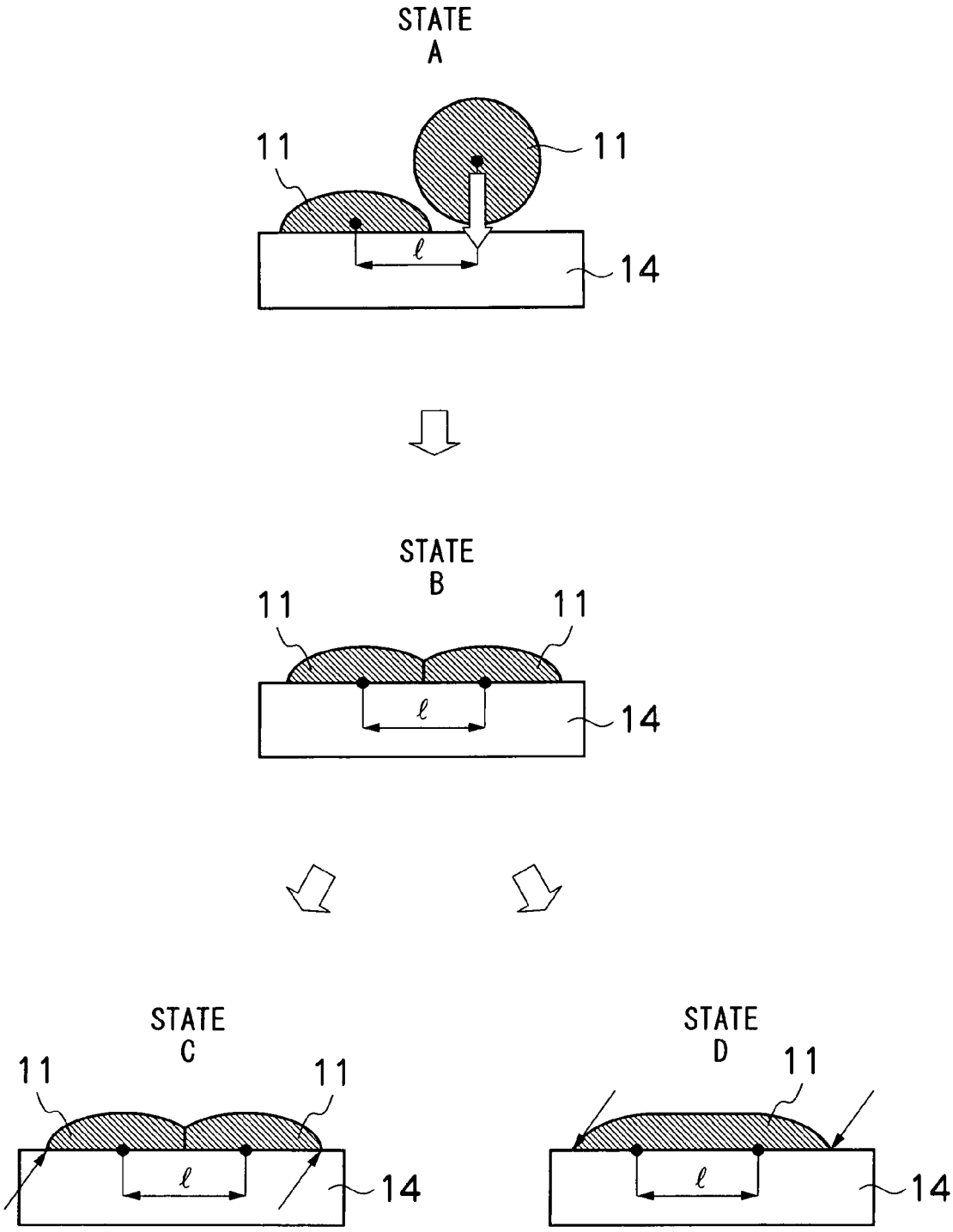
FIG. 3 is a diagram showing the states A to D of deposited droplets viewed from the side, in a case where a solid image is satisfactorily formed.

Here, attention is focused on the deposition (application) of droplets of the first liquid. FIG. 3 is a diagram showing states of dots formed by deposited droplets (hereinafter, referred to as "deposited dots 11" or "deposited droplets 11"), as viewed from the side, and the states A to D of the deposited dots 11 shown in FIG. 3 correspond to a case where a solid image is satisfactorily formed. In the state A shown in FIG. 3, the droplets of the first liquid are deposited on positions that are extremely close to each other on the ejection receiving medium having high liquid-repelling properties. In the state B shown in FIG. 3, the deposited liquid droplets then start to combine together. In the coalescence of the adjacently deposited droplets, the original center of gravity positions of the droplets are maintained as shown in the states C and D of FIG. 3, and the ends (a boundary among the deposited liquid droplets, the intermediate transfer body, and the atmosphere) of the deposited droplets are fixed on the ejection receiving medium as indicated by the arrows in FIG. 3.

Figure 4:
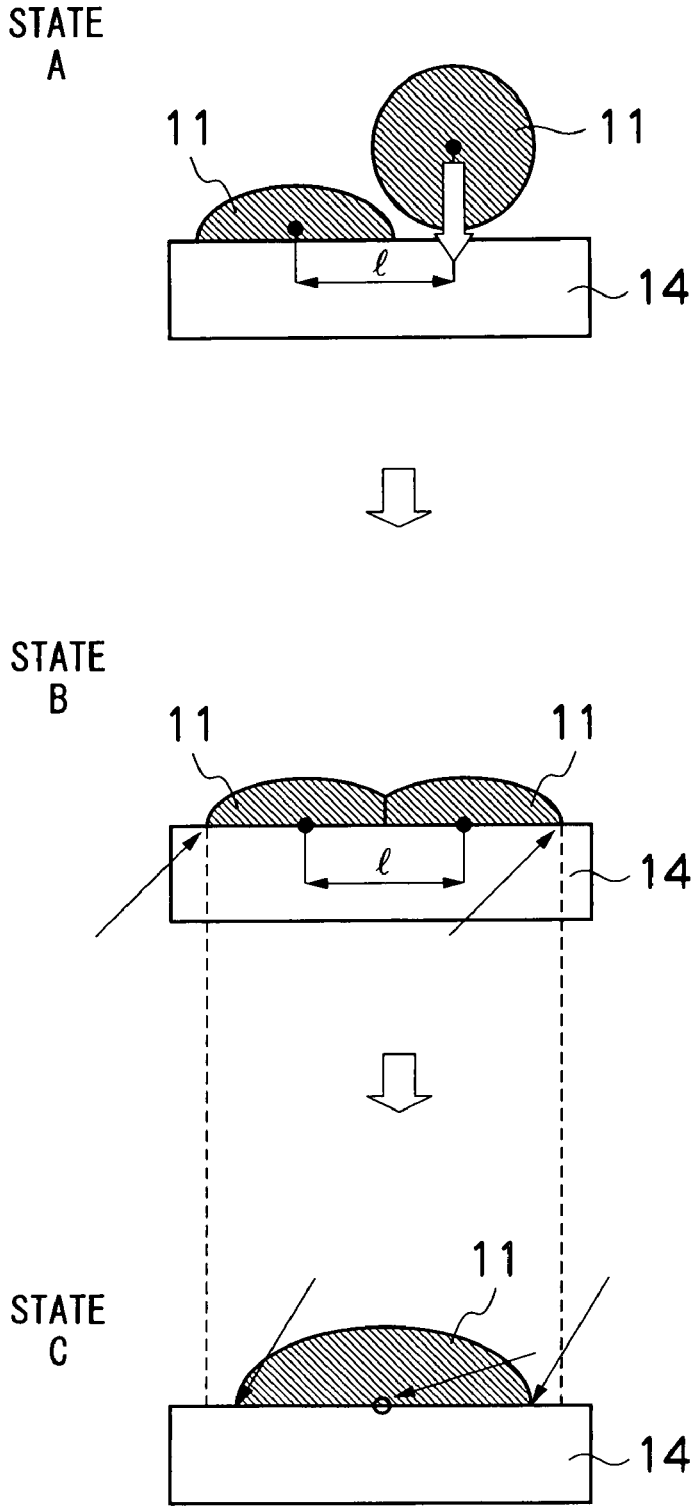
FIG. 4 is a diagram showing the states A to C of deposited droplets viewed from the side, in a case where a solid image is unsatisfactorily formed.

On the other hand, FIG. 4 is a diagram showing states of the deposited dots 11 as viewed from the side, and the states A to C shown in FIG. 4 correspond to a case where a solid image is unsatisfactorily formed. In the state A shown in FIG. 4, the liquid droplets deposit at positions that are extremely close together on the ejection receiving medium having high liquid-repelling properties. In the state B shown in FIG. 4, the deposited droplets then start to combine together. In the state C, the center of gravity of each of the deposited droplets moves from its original position, and the two liquid droplets combine together to form a combined droplet having a center of gravity in a new position. Moreover, the ends of the deposited droplets 11 move when the deposited droplets combine together, and the positions of the ends of the deposited droplets 11 are different between the state B and the state C as indicated by the arrows in FIG. 3. Consequently, a phenomenon occurs whereby the liquid droplets are displaced from their originally intended depositing positions. When the positional displacement of the deposited droplets 11 occurs in this way, if using a medium of low permeability or a non-permeable medium, then a print image cannot be formed at an appropriate position and furthermore, non-uniformity of the deposited droplets occurs on the ejection receiving medium and it is difficult to form a liquid film of uniform thickness.

Therefore, the present inventor carried out evaluations for finding the conditions under which the phenomenon of the positional displacement of the deposited droplets occurs. More specifically, straight lines were printed on the ejection receiving medium, and the printed lines were evaluated. In this evaluations, the printed lines that had an accurate shape of a straight line were evaluated as being free of the positional displacement of the deposited droplets, whereas the printed lines whose shape was an inaccurate shape of a straight line (e.g., a line in which there is an unintentional gap between the adjacent dots) were evaluated as being subject to the positional displacement of the deposited droplets. In evaluating the occurrence or non-occurrence of the positional displacement of the deposited droplets which is an issue to be resolved in the present invention, it is more suitable to print line images rather than solid images. This is because in the case of the line images, it is possible to judge clearly whether the positional displacement has occurred.

Figure 5:
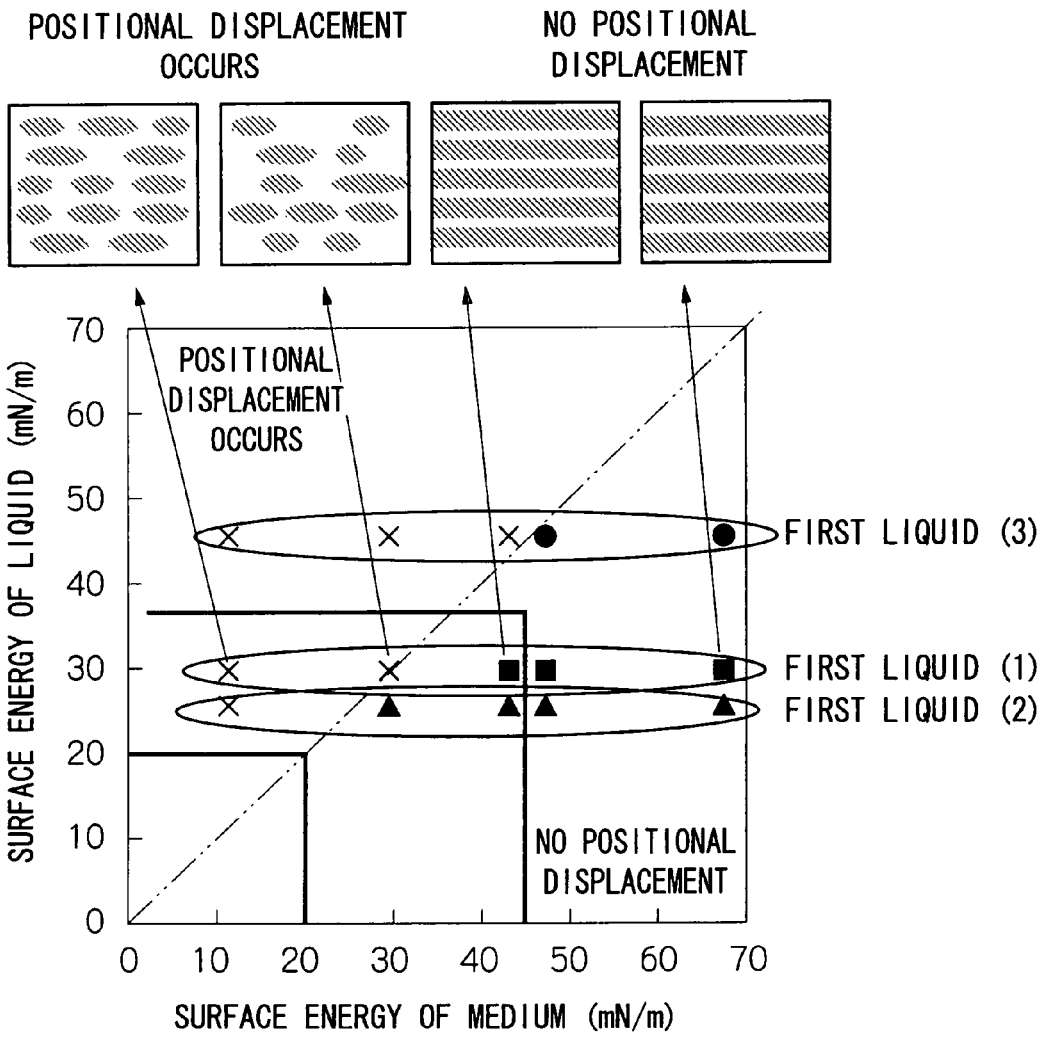
FIG. 5 is a diagram showing the relationship between the occurrence of the position displacement in the deposited droplets and the surface energies of the ejection receiving medium and the liquid.

The straight lines were printed at a distance of 85 μm between line centers, by means of an inkjet recording apparatus having a resolution of 1200 dots per inch (dpi) and a liquid droplet size of 7 picoliter (pl), on a non-permeable medium using the first liquid described below, and the printed lines were evaluated visually. FIGS. 5 and 6 are diagrams showing the results of this evaluation. FIG. 5 is a diagram showing the relationship between the surface energies of the ejection receiving medium and the first liquid, and the occurrence or the non-occurrence of the positional displacement of the deposited droplets. If there is no positional displacement, then lines of accurate straight shape can be printed without any gaps between the adjacent dots, whereas if there is the positional displacement, then the center of gravity positions of the deposited dots are displaced, giving rise to gaps between the adjacent dots, and hence lines of an accurate straight shape are not printed. Furthermore, FIG. 6 is a diagram showing evaluation results relating to the occurrence of the positional displacement when the type of the ejection receiving medium and the surface energy of the first liquid are varied. In FIG. 6, the symbol "A" indicates an absence of the positional displacement and the symbol "B" indicates the occurrence of the positional displacement.

Liquids having the compositions described below was used as the first liquid.

<First Liquid (1)>
deionized water: 68 wt %
glycerine: 20 wt %
diethylene glycol: 10 wt %
Olfine: 1.5 wt %
pH adjuster: trace <First Liquid (2)>
deionized water: 68 wt %
glycerine: 20 wt %
diethylene glycol: 10 wt %
Olfine: 1.5 wt %
fluorochemical surfactant: 0.1 wt %
pH adjuster: trace <First Liquid (3)>
deionized water: 69 wt %
glycerine: 20 wt %
diethylene glycol: 10 wt %
Olfine: 1 wt %
pH adjuster: trace According to the evaluation results shown in FIGS. 5 and 6, it can be seen that the phenomenon of the positional displacement of the deposited droplets does not occur when the surface energy $\gamma_S$ of the ejection receiving medium and the surface energy $\gamma_L$ of the first liquid have the following relationship:

$$\gamma_S \geqq \gamma_L. \tag{1}$$

Figure 7A:
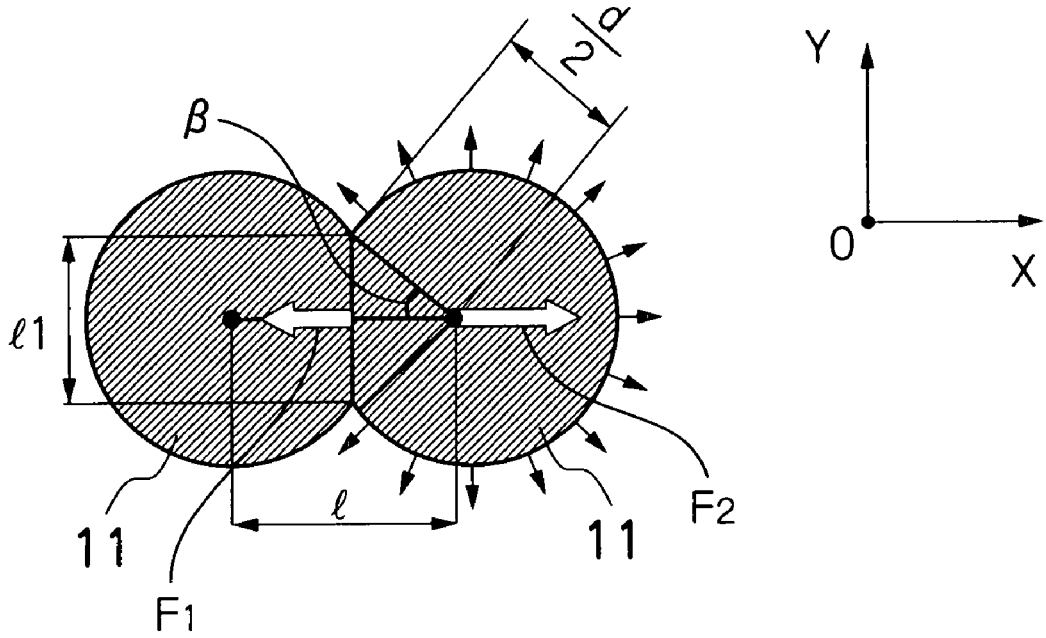
FIGS. 7A and 7B are diagrams showing the forces acting on the right deposited droplet shown in FIGS. 3 and 4, after deposition and stabilization.
Figure 7B:
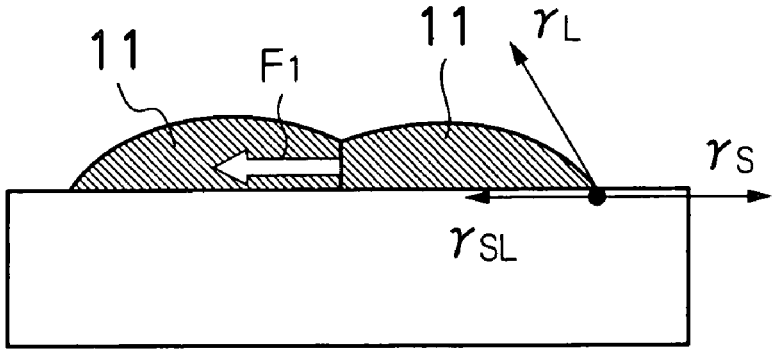

The conditions expressed by Formula (1) are described in detail below by means of numerical expressions. FIGS. 7A and 7B are diagrams showing the forces acting on the right dot (of the deposited dots 11) shown in FIGS. 3 and 4, after being deposited and stabilized. FIG. 7A is a diagram in which the deposited dots 11 are viewed from above and FIG. 7B is a diagram where the deposited dots 11 are viewed from the side. The deposited dot 11 on the left-hand side also receives the same forces as the other deposited dot 11 (on the right-hand side), due to the law of action and reaction.

In the state after deposition and stabilization, the force $F_1$ by the left deposited droplet which pulls the right deposited droplet is expressed by the following expression:

$$F_1 = l_1 \times \gamma_L = 2 \times \gamma_L \times \sqrt{\left(\frac{d}{2}\right)^2 - \left(\frac{l}{2}\right)^2}. \tag{2}$$

Here, $l_1$ is a width of the overlapping section of the deposited dots 11, and it can be determined from the set resolution. Moreover, d is a diameter of each of the deposited dots 11, and d is the value measured when a distance l between the deposited dots has enlarged sufficiently. In the present embodiment, l is the maximum of the resolution pitch, namely, the distance between the deposited dots as determined from the droplet ejection frequency and the media conveyance speed.

Furthermore, considering the XY axes shown in FIG. 7A, the total $F_2$ of the X direction components of the interface tension acting between the deposited dot 11 on the right-hand side and the ejection receiving medium is expressed by the following relationship:

$$F_2 = 2 \times \frac{d}{2} \times \gamma_S \times \int_0^{\pi-\beta} \cos x \, dx \tag{3}$$

-continued $$= 2 \times \frac{d}{2} \times \gamma_S \times \sin(\pi - \beta) = d \times \gamma_S \times \sin\beta.$$

Here, the following equation is satisfied in respect of the angle β indicated in FIG. 7A:

$$\sin\beta = \frac{2}{d} \times \sqrt{\left(\frac{d}{2}\right)^2 - \left(\frac{l}{2}\right)^2}. \tag{4}$$

By substituting Formula (4) into Formula (3), $F_2$ is then represented by the following equation:

$$F_2 = 2 \times \gamma_S \times \sqrt{\left(\frac{d}{2}\right)^2 - \left(\frac{l}{2}\right)^2}. \tag{5}$$

In this case, the positional displacement of the deposited droplets does not occur, provided that the following condition is satisfied:

$$F_2 \geqq F_1. \tag{6}$$

By substituting Formulae (2) and (5) into Formula (6) and rearranging, it is possible to obtain the expression of Formula (1). Consequently, it is established by the derivation of the above expressions that the positional displacement of the deposited droplets is prevented from occurring when forming a solid image region, provided that the conditions of Formula (1) are satisfied.

Furthermore, in the state of the dot (deposited droplet) after stabilization, there are cases where the deposited dots remain mutually independent as shown in the state C of FIG. 3, and there are also cases where the deposited dots are joined together as shown in the state D of FIG. 3. When forming a solid image, it is more desirable that the deposited dots join together as shown in the state D of FIG. 3, without the occurrence of any positional displacement of the deposited droplets.

Figure 8:
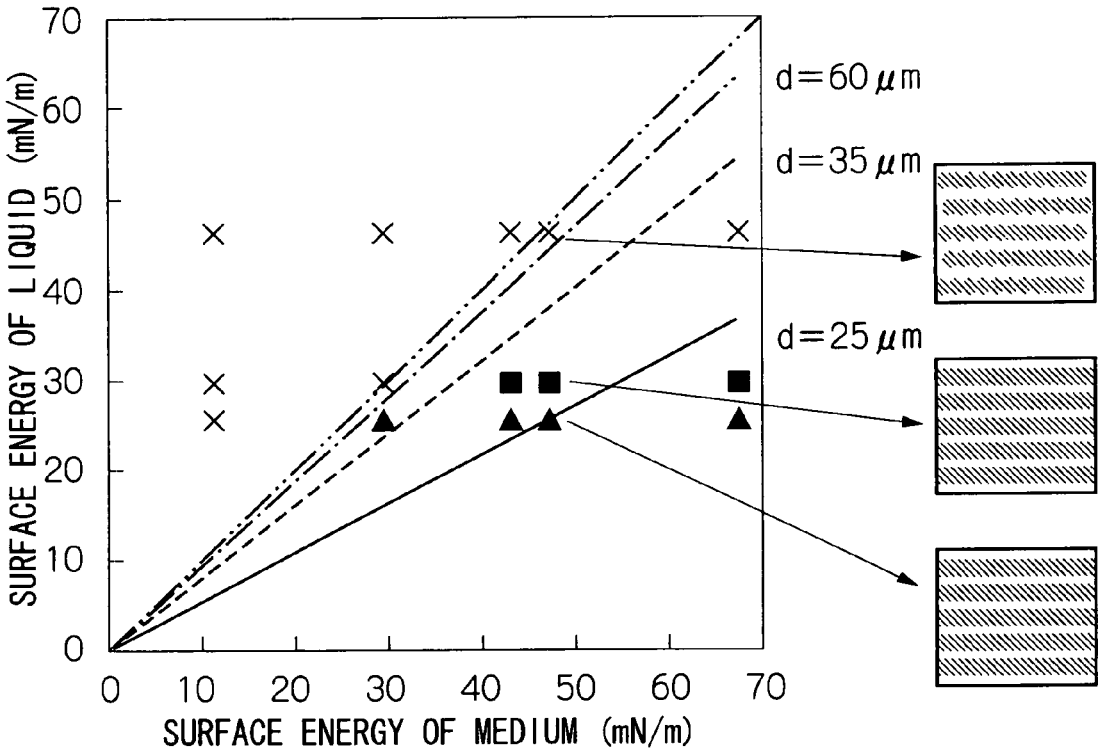
FIG. 8 is a graph showing the evaluation results for the droplet joining characteristics.

Therefore, measurement was carried out while varying the type of liquid and the type of ejection receiving medium used. FIG. 8 is a diagram showing a graph indicating the evaluation results for the joining characteristics of the deposited dots (deposited droplets), and FIG. 9 is a diagram showing the results of visual evaluation of the joining characteristics of the deposited dots. In FIG. 9, the symbol "A" indicates a state where there is no positional displacement of the deposited droplets or a state where the dots are coalesced (join together), and the symbol "B" indicates a state where there is the positional displacement of the deposited droplets or a state where the dots are not coalesced. Under the conditions shown in FIG. 8 where the dots join together, the edges of a printed line are straight, whereas under the conditions where the dots do not join together, the edges of the line are ripply. In the latter conditions, even if a solid image is formed by reducing the distance between the centers of the lines, the ends of the solid image forming region are still ripply and the quality of the solid image is not adequate. According to the evaluation results shown in FIGS. 8 and 9, it can be seen that the deposited dots join together when the following condition is satisfied:

$$2\times\gamma_S\times\sqrt{\left(\frac{d}{2}\right)^2-\left(\frac{l}{2}\right)^2}\geq d\times\gamma_L. \quad (7)$$

As shown in FIG. 9, no positional displacement of the deposited droplets occurred provided that the conditions of the above-described inequality expression (1) were satisfied. However, even when the inequality expression (1) was met, there were cases where the coalescence of the deposited droplets as shown in the state D of FIG. 3 did not occur. From the evaluation results shown in FIG. 9, it can be seen that the above inequality expression (7) is required to be satisfied, in order for the deposited droplets to join together as shown in the state D of FIG. 3. Consequently, it is preferable that not only the inequality expression (1) but also the inequality expression (7) be satisfied, in order to avoid the position displacement and to achieve the coalescence of the deposited droplets.

Figure 10A:
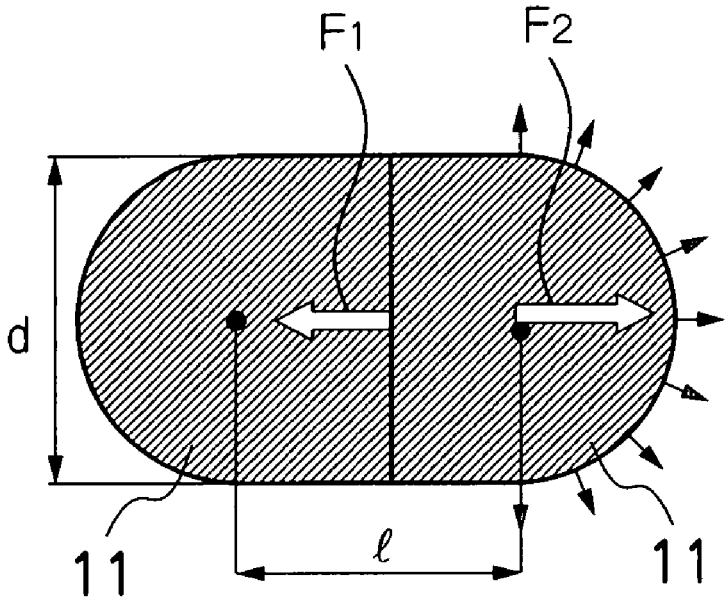
FIGS. 10A and 10B are diagrams showing the forces which act on the right droplet in a case of the state D shown in FIG. 3.
Figure 10B:
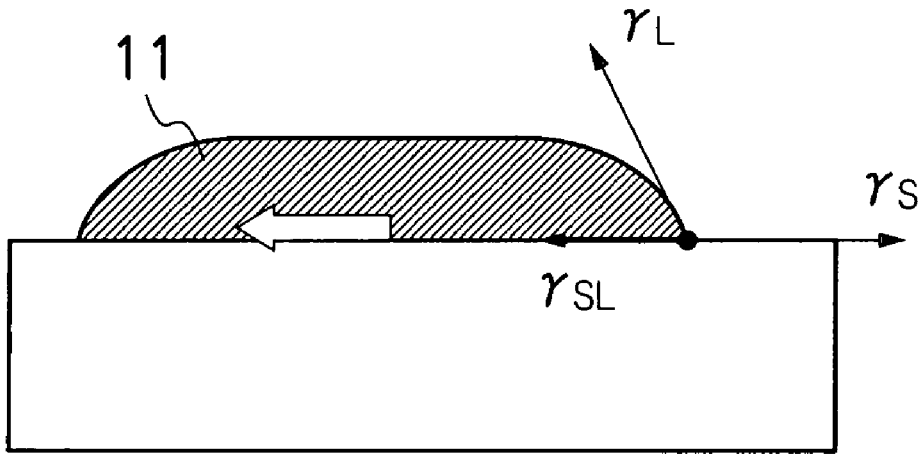

Next, the condition under which the deposited dots join together, without giving rise to the positional displacement of the deposited droplets, will be described in detail on the basis of numerical equations. FIGS. 10A and 10B are diagrams which correspond to the state D shown in FIG. 3. FIG. 10A is a diagram in which the deposited dots 11 are viewed from above and FIG. 10B is a diagram in which the deposited dots 11 are viewed from the side. These diagrams show the forces acting on the liquid droplet on the right-hand side.

The inequality expression (7) can be derived from the inequality expression (6) as described below. In the state after deposition and stabilization, the maximum value of the force (the force corresponding to a case of the coalesced droplets shown in FIG. 10A) $F_1$ by the left deposited droplet which pulls the right deposited droplet is expressed by the following equation:

$$F_1=d\times\gamma_L. \quad (8)$$

The total of the X direction components of the interface tension acting between the deposited dots 11 and the ejection receiving medium has a value up to $F_2$ as given by Formula (5) stated above.

Consequently, by substituting the expressions (5) and (8) into the inequality expression (6) and rearranging, the conditions under which the liquid droplets join together, without giving rise to the positional displacement of the deposited droplets, are expressed by the inequality expression (7). According to the foregoing, it is established by the derivation of the above expressions that the liquid droplets will join together, without giving rise to the positional displacement of the deposited droplets when forming a solid image, provided that the conditions of the inequality expression (7) are satisfied.

This recording method is particularly effective in the case of an intermediate transfer type of recording apparatus. In the case of a direct printing system, it is possible to resolve the issue of forming a uniform film by using material having high surface energy as the ejection receiving medium, or by coating the surface of the ejection receiving medium with a liquid repelling layer, but in the case of an intermediate transfer system, it is necessary to use a material having a relatively low surface energy of 50 mN/m or less, in order to raise the transfer rate of the coloring material. Therefore, the present recording method, which can be controlled by means of not only the surface energy of the ejection receiving medium but also the surface tension of the first liquid, the resolution, and the liquid droplet size after deposition, is suitable for intermediate transfer recording.

In terms of ejection characteristics, the surface tension of the liquid at an ambient temperature of 25° C. is preferably 20 mN/m or above. Consequently, the surface energy of the ejection receiving medium needs to be equal to or greater than 20 mN/m and equal to or less than 50 mN/m.

Next, the conditions under which the liquid droplets overlap with each other on the ejection receiving medium having high liquid-repelling properties will be described. The angle of contact and the spreading rate of the first liquid on various types of intermediate transfer bodies have the following relationship: (spreading rate)=(size of deposited droplet)/(size of ejected droplet). Here, "deposited droplet" indicates a droplet that has been deposited on the ejection receiving medium, and "ejected droplet" indicates a droplet that has been ejected from the ejection head but has not arrived at the surface of the ejection receiving medium, in other words, a droplet in flight.

The shape of the meniscus (an interface between the atmosphere and a liquid droplet) of a liquid droplet on a solid has been deduced by J. C. Adams and R. Bashforth, and in the case of a minute droplet having a size in the micron order, in which the weight of the droplet can be ignored, the shape of the meniscus can be considered to be virtually identical to the shape of a sphere cut along a flat plane.

Figure 11A:
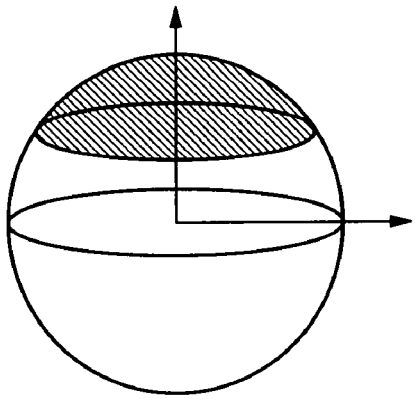
FIGS. 11A and 11B are diagrams showing a model used to illustrate the shape of the deposited droplet (meniscus)
Figure 11B:
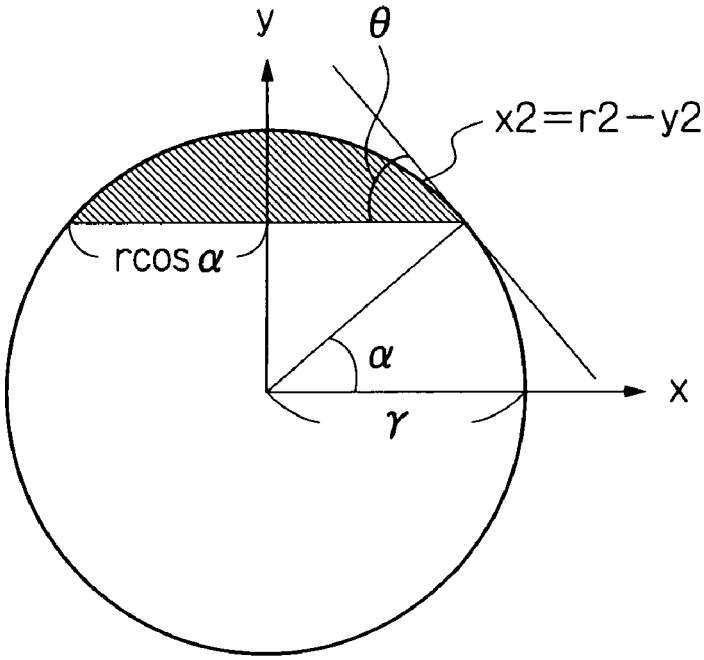

FIGS. 11A and 11B are diagrams showing a model for illustrating the meniscus shape. As shown in FIG. 11B, if the angle of contact between the liquid droplet and the ejection receiving medium is taken to be θ, then the angle α shown in FIG. 11B is expressed by the following expression:

$$\alpha=\frac{\pi}{2}-\theta. \quad (9)$$

Consequently, if the radius of the droplet (ejected droplet) before deposition is taken to be $r_0$, and the radius of the droplet (deposited droplet) after deposition is taken to be $r\times\cos\alpha$, then the spreading rate of the droplet is expressed by the following equation:

$$\zeta=\frac{r}{r_0}\times\cos\alpha=\left\{\frac{4}{2-3\times\sin\alpha+(\sin\alpha)^3}\right\}^{\frac{1}{3}}\times\cos\alpha. \quad (10)$$

Figure 12A:
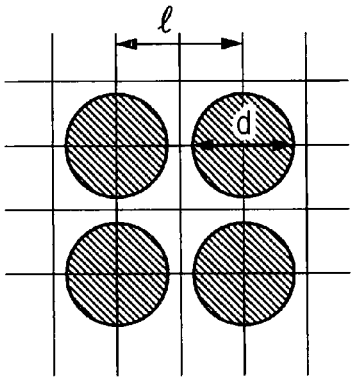
FIGS. 12A to 12D are diagrams showing the relationship between the size of the deposited droplet and the resolution pitch.
Figure 12C:
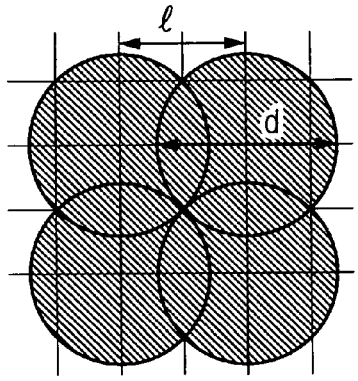
Figure 12B:
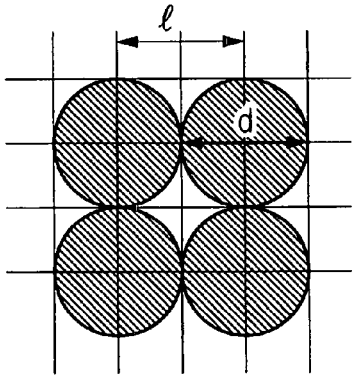

Here, FIGS. 12A to 12D show the relationship between the size of the liquid droplet and the resolution pitch. The droplet diameter after deposition is d (=2r×cos α), and the maximum of the resolution pitch is l. In this case, if d<l, then a large gap occurs between the deposited droplets, as shown in FIG. 12A. Furthermore, if d=l, then the deposited dots 11 make contact with each other at some points, but gaps occur between the deposited dots, as shown in FIG. 12B.

On the other hand, if $d=\sqrt{2}\times l$, then the gaps between the deposited dots 11 disappear, as shown in FIG. 12C. Consequently, the condition whereby the deposited dots 11 are arranged without gaps is expressed by the following relationship:

$$d\geqq\sqrt{2}\times l. \quad (11)$$

Consequently, by rearranging on the basis of Formulae (10) and (11), the condition for printing a solid image without leaving any uncovered surface is expressed by the following relationship. Here, $r_0$ is the radius of the droplet (ejected droplet) before deposition.

$$2 \times r_0 \times \left\{ \frac{4}{2 - 3 \times \sin\alpha + (\sin\alpha)^3} \right\}^{\frac{1}{3}} \times \cos\alpha \geq \sqrt{2} \times l \quad (12)$$

Here, it would be possible to form a solid image by raising the overlap rate of the ink droplets and depositing a large volume of ink. However, if a large volume of ink is deposited, then ink wastage occurs. Furthermore, density non-uniformities also occur due to differences in the amount of overlap.

Figure 12D:
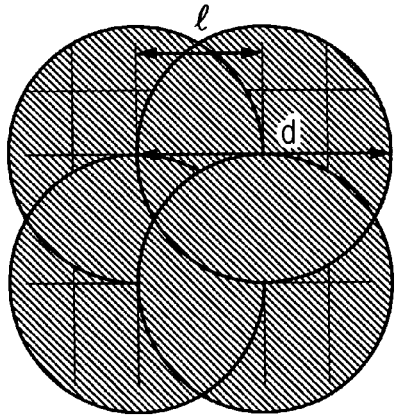

Therefore, a case where d=2l as shown in FIG. 12D is taken as the upper limit of the overlap rate between the ink droplets. Consequently, taking the size of the droplets after deposition to be d and taking the maximum of the resolution pitch to be l, it is desirable to satisfy the following condition, as an indicator of the ink overlap rate:

$$2l \geqq d \geqq \sqrt{2} \times l. \quad (13)$$

Next, a case is described in which droplets of the first liquid are deposited, whereupon droplets of the second liquid are deposited. Here, it is supposed that a solid image (uniform liquid film) is formed by means of the first liquid, and an image is then formed thereon by means of the second liquid. In order to achieve a satisfactory image, it is necessary for the second liquid to deposit on the liquid film formed by the first liquid. If the second liquid is deposited on a region where the center of gravity of the first liquid has been displaced and where the surface of the ejection receiving medium is exposed, then a phenomenon occurs whereby the spreading rate (=droplet size after deposition/droplet size before deposition) of the liquid droplets on such a region differs greatly from the spreading rate on a region where the second liquid is deposited on a film of the first liquid.

Moreover, in cases where a liquid which has reactive properties with respect to the second liquid is used as the first liquid, if the second liquid is deposited on a region where the center of gravity of the first liquid has been displaced, then only a portion of the droplet will react and the deposited dot 11 will not have a circular shape. In this case, if the ejection receiving medium is an intermediate transfer body, then the image on the intermediate transfer body is transferred to a recording medium without sufficient reaction, resulting in the transfer non-uniformities. Therefore, especially in the case of an intermediate transfer type of inkjet recording apparatus which uses two liquids (i.e., the first liquid and the second liquid), in the process of depositing the first liquid, it is necessary to prevent the occurrence of the position displacement in the deposited droplets of the first liquid.

In order to investigate the advantageous effect of the present invention, the present inventor carried out evaluations relating to the achievement of good images by using the first liquid and the second liquid. The first liquid was deposited on the intermediate transfer body at a dot density of 1200 dpi×600 dpi and a droplet size of 7 pl, and a line pattern of the second liquid was recorded thereon at a dot density of 1200 dpi×600 dpi and a droplet size of 7 pl, in an area of 30 mm×30 mm. The image forming properties of the first liquid and the image forming properties and transfer characteristics of the second liquid were evaluated visually.

Figure 14A:
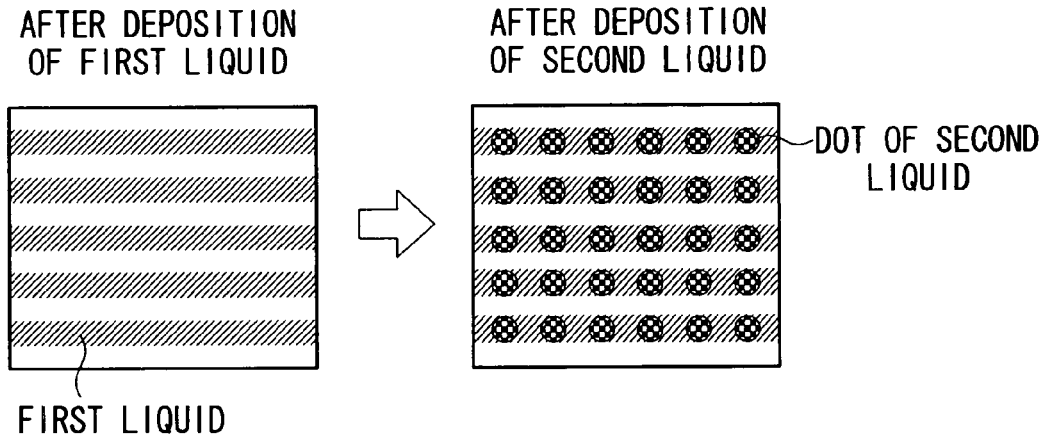
FIGS. 14A and 14B are diagrams showing typical images observed in a visual evaluation relating to the image forming characteristics of the first liquid, the image forming characteristics of the second liquid, and transfer characteristics of the second liquid.

FIG. 13 is a diagram showing the evaluation results relating to the image forming properties of the first liquid and the image forming properties of the second liquid. In FIG. 13, the symbol "A" indicates a case where the liquid (first liquid or second liquid) has good image forming properties, and the symbol "B" indicates a case where the liquid (first liquid or second liquid) has poor image forming properties. With respect to the image forming characteristics of the first liquid, under the conditions shown in FIG. 6 which allow the formation of a good line image, a good solid image was obtained and a liquid film which was free of gaps could be formed by means of the first liquid. It was confirmed that under conditions which satisfy Formulae (1) and (12), a good solid image could be obtained by means of the first liquid. The results relating to the image forming characteristics of the second liquid, as indicated in FIG. 13, directly reflect the results for the image forming characteristics of the first liquid, and as shown in FIG. 14A, if a satisfactory solid image of the first liquid can be obtained, then it is possible to obtain a satisfactory image by means of the second liquid also.

Figure 14B:
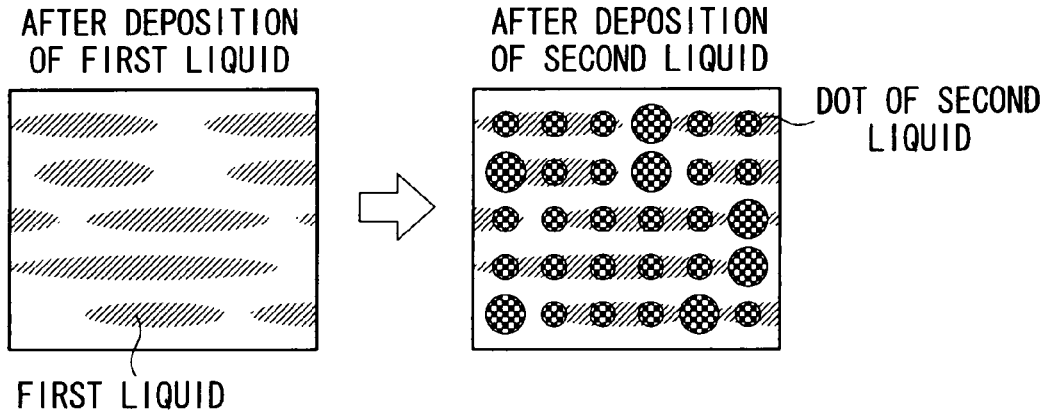

As shown in FIG. 14B, if gaps occur between the droplets of the first liquid, then any droplets of the second liquid which deposit on the gaps (i.e., region on which no droplet of the first liquid is deposited) spread further than the droplets of the second liquid which deposit on the liquid film, and hence variation occurs in the size of the deposited dots. Moreover, in the present embodiment, since there is reactivity between the first liquid and the second liquid, the reaction proceeds only in locations where the first liquid and the second liquid are in contact with each other.

Moreover, in terms of reactivity, it can be confirmed that the reaction proceeds satisfactorily if the image forming characteristics of the second image are satisfactory. However, with respect to the transfer characteristics, in the case of the ejection receiving medium made of glass, the surface energy of the ejection receiving medium is high and therefore the transfer rate is low, as described previously.

Furthermore, the hardness of the intermediate transfer body also affects the transfer characteristics, and the intermediate transfer body made of a substance having the elastic properties such as rubber, makes good contact with the recording paper and therefore yields a high transfer rate. An OHP sheet or glass sheet has relatively high hardness and therefore the results relating to the transfer rate for these materials are inferior to the transfer rate for fluorine-containing rubber.

Description of First Liquid and Second Liquid

The object of the first liquid is to prevent disturbance of the image of the second liquid, and the first liquid may also be reactive with respect to the second liquid. Here, a "reaction" means a reaction that causes an increase in the viscosity of the second liquid. This term includes causing aggregation of the pigment (coloring material) contained in the second liquid.

The first liquid and the second liquid may produce aggregation by means of a cation-anion reaction, but the present invention is not limited to this. In the present embodiment, a liquid which has a low pH and thereby has the function of causing a solvent-insoluble material in the second liquid to aggregate, is used for the first liquid.

The pigment may be any one of: C.I. Pigment Yellow 12, 13, 17, 55, 74, 97, 120, 128, 151, 155 and 180, or C.I. Pigment Red 122, C.I. Pigment Violet 19, C.I. Pigment Red 57:1, 146, or C.I. Pigment Blue 15:3, and here Pigment Red is used as a sample.

In order to eject both the first liquid and the second liquid satisfactorily from the inkjet head, it is desirable that the surface tension of the first and second liquids be 20 mN/m to 50 mN/m and that the viscosity of the first and second liquids be 1 mPa·s to 20 mPa·s, at the ambient temperature of 25° C.

Moreover, there may be a case where an image that has been transferred to the recording medium by means of the intermediate transfer inkjet recording apparatus has low resistance to rubbing and contains cracks. This kind of phenomenon is particularly marked in cases where the deposition volume of the second liquid is large, for instance, when forming a solid image. This problem regarding the resistance to rubbing is resolved by incorporating a process for adding a fixing characteristics enhancing agent (fixing improver) to the first liquid.

The fixing characteristics enhancing agent may be an acrylic polymer, an urethane polymer, an ester polymer, a vinyl polymer, a styrene polymer, or the like. In order to display sufficiently the functions of the material in improving fixing characteristics, it is necessary to add a polymer of relatively high molecular weight, at a high concentration (1 wt % to 20 wt %). However, if it is sought to add the aforementioned materials by dissolving in the liquid, then the liquid acquires a high viscosity and the ejection characteristics decline. In order to add a suitable material at a high concentration and to suppress the increase in the viscosity, it is effective to add the material in the form of a latex. Examples of a latex material include, for instance: an alkyl acrylate copolymer, a carboxy-modified SBR (styrene butadiene rubber), SIR (styrene—isoprene rubber), MBR (methylmethacrylate—butadiene rubber), NBR (acrylonitrile—butadiene rubber), and the like.

The glass transition point Tg of the latex has a significant effect during the fixing process, and desirably, it is equal to or greater than 50° C. and equal to or less than 120° C., in order to achieve both stability during storage at normal temperature and good fixing characteristics after heating. Furthermore, the minimum film formation temperature (MFT) of the latex also has a significant effect during the fixing process, and in order to achieve satisfactory fixing at a low temperature, desirably, the MFT is not more than 100° C., and more desirably, not more than 50° C.

The present inventor prepared a plurality of latex materials having good dispersive properties, added each of the latex materials at a concentration of 5 wt % to a first liquid, and obtained a solid image on fluorine-containing rubber in an area of 30 mm×30 mm. The image thus formed is transferred to an art paper, and then a rubbing experiment was carried out with respect to the transferred image. In the rubbing experiment, the image was rubbed ten times by finger through an art paper placed on the image, and an evaluation was carried out on the basis of the color of the coloring material deposited on the art paper placed on the image. As a result of this, in each of the cases, fixing characteristics were improved compared to a case where latex was not added, and the results were particularly good where an acrylic latex was used.

Composition of Inkjet Recording Apparatus

An intermediate transfer type of inkjet recording apparatus which forms the image forming apparatus according to an embodiment of the present invention, will be described in detail. As described above, FIG. 1 is a general schematic drawing of the intermediate transfer type of inkjet recording apparatus 10A. The inkjet recording apparatus 10A is principally constituted of an intermediate transfer body, a first liquid application device, a second liquid application device, a marking device, a transfer device, a conveyance device, and the like.

As shown in FIG. 1, the print unit 12 corresponds to the first liquid application device and the second liquid application device, and the print unit 12 has a plurality of inkjet heads (hereinafter, called "heads") 12P, and 12Y, 12M, 12C and 12K which are provided to correspond respectively to a treatment liquid (P) forming the first liquid, and respective inks of yellow (Y), magenta (M), cyan (C) and black (K) forming the second liquids.

The intermediate transfer body 14 has an endless shape and is spanned between rollers 38 and 40 which form a conveyance device and a transfer pressurization roller 42. The material used for the intermediate transfer body 14 is, for example, a silicon rubber sheet, fluorine-containing rubber, hardened polyvinyl chloride, PET, glass or the like.

The solvent removal member includes: a solvent removal unit 26 constituted of an absorbing roller 22, a recovery section 26, and the like; and a solvent drying unit 28. The solvent removal method employed by the solvent removal unit 26 may be, for example, a method in which a porous member in the form of a roller is abutted against the intermediate transfer body 14, a method in which excess solvent is removed from the intermediate transfer body 14 by means of an air knife, a method in which solvent is evaporated and removed by heating, or the like. In the present embodiment, a method is used in which a inorganic porous material (a material formed by sintering alumina particles) is abutted against the intermediate transfer body 14. By adopting a solvent removal device of this kind, then even if a large amount of treatment liquid is deposited onto the intermediate transfer body 14, since the solvent is removed by the solvent removal unit 26, then large amounts of the solvent are never transferred onto the recording paper 16. Consequently, there is no occurrence of problems that are liable to occur in the case of water-based solvents, such as curling or cockling of the recording paper 16.

Furthermore, the inkjet recording apparatus 10A includes: a transfer body cleaning unit 18, which cleans the intermediate transfer body 14; and the conveyance unit 20 which is provided in a position opposing the intermediate transfer body 14 and which conveys the recording paper 16 while holding the recording paper 16 flat.

In the transfer device, the intermediate transfer body 14 and the recording paper 16 are sandwiched between two transfer pressurization rollers 42 and 44. Although the principal function of the transfer device is pressurization, the transfer pressurization roller 44 is also provided with a heating function.

The conveyance unit 20 includes a belt 21, and the belt 21 is sandwiched between the transfer pressurization rollers 42 and 44 and between the fixing pressurization rollers 46 and 48. The recording paper 16 is held on the belt 21 of the conveyance unit 20 and is conveyed from left to right in FIG. 1. Thereupon, the recording paper 16 is heated by the heating function of the fixing pressurization roller 46 and the image formed on the conveyed recording paper 16 is fixed.

The heads 12P, 12Y, 12M, 12C and 12K of the print unit 12 each have a length corresponding to the maximum width of the intermediate transfer body 14, and they are full-line heads in which a plurality of nozzles for ejecting ink are arranged in the nozzle face of the head.

The print heads 12P, 12Y, 12M, 12C and 12K are arranged in order of treatment liquid (P), yellow (Y), magenta (M), cyan (C), black (K) from the upstream side in the feed direction of the intermediate transfer body 14, and these heads 12P, 12Y, 12M, 12C and 12K are each fixed extending in a direction substantially perpendicular to the conveyance direction of the intermediate transfer body 14.

Firstly, the treatment liquid (first liquid) containing an aggregating agent is ejected from the head 12P while the intermediate transfer body 14 is conveyed, and the ink liquids (second liquids) containing coloring materials of different colors are ejected respectively from the heads 12Y, 12M, 12C and 12K, thereby forming a mixed liquid of the treatment liquid and each of the ink liquids on the intermediate transfer body 14. Thereupon, a coloring material aggregate is generated in this mixed liquid by subjecting the coloring material to the aggregation reaction caused by the aggregating agent, and a color image is formed on the intermediate transfer body 14 by means of this coloring material aggregate. Thereupon, the liquid portion of the mixed liquid is removed by the solvent removal unit 26, and the aggregate of the coloring material on the intermediate transfer body 14 is transferred to the recording paper 16 conveyed by the conveyance unit 20, whereby a color image can be formed on the recording paper 16.

In this way, by adopting a configuration in which full line heads 12K, 12C, 12M and 12Y, each having nozzle rows covering the full width of the intermediate transfer body 14 which ultimately forms an image by transfer, are provided for each separate color in this way, it is possible to record an image on the full surface of the recording paper 16 by performing just one operation of moving the intermediate transfer body 14 and the print unit 12 relatively to each other, in the conveyance direction of the intermediate transfer body 14 (in other words, by means of one sub-scanning action). Higher-speed printing is thereby made possible and productivity can be improved in comparison with a shuttle type head configuration in which a recording head moves back and forth reciprocally in a direction perpendicular to the conveyance direction of the intermediate transfer body 14.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged. In addition, transfer can be performed while heating in order to raise the transfer rate or to control the glossiness of the image surface.

Next, a direct printing type of inkjet recording apparatus which forms the image forming apparatus according to another embodiment of the present invention, will be described. As described above, FIG. 2 is a general schematic drawing of the direct printing type of inkjet recording apparatus 10B.

This inkjet recording apparatus 10B differs from the intermediate transfer type of inkjet recording apparatus 10A in that it includes: a paper supply unit 19 which supplies a recording paper 16 forming a recording medium; a decurling unit 17 which removes curl from the recording paper 16; a belt conveyance unit 23, disposed facing the nozzle face (ink ejection face) of the print unit 12, which conveys the recording paper 16 while keeping the recording paper 16 flat; a solvent removal unit 31 which removes the liquid component of the mixed liquid; and a paper output unit 25 which outputs the recorded recording paper (printed matter) to the exterior.

The other features of the inkjet recording apparatus 10B are the same as those of the intermediate transfer type of inkjet recording apparatus 10A.

In FIG. 2, a magazine for rolled paper (continuous paper) is shown as an example of the paper supply unit 19; however, a plurality of magazines with papers of different paper width and quality may be jointly provided. Moreover, papers may be supplied in cassettes that contain cut papers loaded in layers and that are used jointly or in lieu of magazines for rolled papers.

The recording paper 16 delivered from the paper supply unit 19 retains curl due to having been loaded in the magazine. In order to remove the curl, heat is applied to the recording paper 16 in the decurling unit 17 by a heating drum 29 in the direction opposite to the curl direction in the magazine. At this time, the heating temperature is preferably controlled in such a manner that the recording paper 16 has a curl in which the surface on which the print is to be made is slightly rounded in the outward direction.

In the case of the configuration in which roll paper is used, a cutter (a first cutter) 27 is provided as shown in FIG. 2, and the continuous paper is cut to a desired size by the cutter 27. When cut paper is used, the cutter 27 is not required.

After decurling, the cut recording paper 16 is delivered to the belt conveyance unit 23. The belt conveyance unit 23 has a configuration in which an endless belt 39 is set around rollers 43 and 45 so that the portion of the endless belt 39 facing at least the nozzle face of the print unit 12 forms a plane (flat surface).

The belt 39 has a width that is greater than the width of the recording paper 16, and a plurality of suction apertures (not shown) are formed on the belt surface. A suction chamber 37 is disposed in a position facing the nozzle face of the print unit 12 on the interior side of the belt 39, which is set around the rollers 43 and 45, as shown in FIG. 2; and a negative pressure is generated by suctioning air from the suction chamber 37 by means of a fan 35, thereby the recording paper 16 on the belt 39 is held by suction. It is also possible to use an electrostatic attraction method, instead of a suction-based attraction method.

The belt 39 is driven in the clockwise direction in FIG. 2 by the motive force of a motor being transmitted to at least one of the rollers 43 and 45, which the belt 39 is set around, and the recording paper 16 held on the belt 39 is conveyed from left to right in FIG. 2.

Since ink adheres to the belt 39 when a marginless print job or the like is performed, a belt-cleaning unit 36 is disposed in a predetermined position (a suitable position outside the printing area) on the exterior side of the belt 39. Although the details of the configuration of the belt-cleaning unit 36 are not shown, examples thereof include a configuration in which the belt 39 is nipped with a brush roller and a water absorbent roller, an air blow configuration in which clean air is blown onto the belt 39, or a combination of these. In the case of the configuration in which the belt 39 is nipped with the cleaning roller, it is preferable to make the linear velocity of the cleaning roller different than that of the belt 39, in order to improve the cleaning effect.

Instead of the belt conveyance unit 23, it may also be possible to use a roller nip conveyance mechanism, but when the printing area passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable.

A heating fan 41 is provided on the upstream side of the print unit 12 in the paper conveyance path formed by the belt conveyance unit 23. This heating fan 41 blows heated air onto the recording paper 16 before printing, and thereby heats up the recording paper 16. Heating the recording paper 16 before printing means that the ink will dry more readily after deposited on the paper.

The printed matter generated is outputted from the paper output unit 25. The target print (i.e., the result of printing the target image) and the test print are preferably outputted separately. In the inkjet recording apparatus 10A, a sorting device (not shown) is provided for switching the outputting pathways in order to sort the printed matter with the target print and the printed matter with the test print, and to send them to paper output units 25A and 25B, respectively. When the target print and the test print are simultaneously formed in parallel on the same large sheet of paper, the test print portion is cut and separated with a cutter (second cutter) 49. Although not shown in FIG. 2, the paper output unit 25A for the target prints is provided with a sorter for collecting prints according to print orders.

Structure of the Head

Next, the structure of the head (ejection head) will be described. The respective heads 12P, 12K, 12C, 12M and 12Y have the same structure, and a reference numeral 50 is hereinafter designated to any of the heads.

Figure 15A:
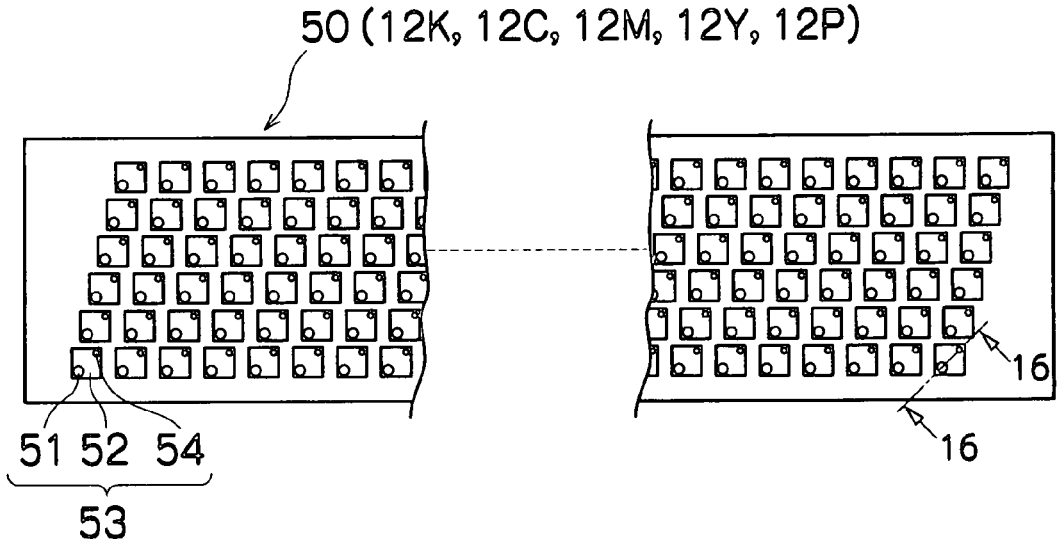
FIG. 15A is a plan view perspective diagram showing an example of the composition of a head.
Figure 15B:
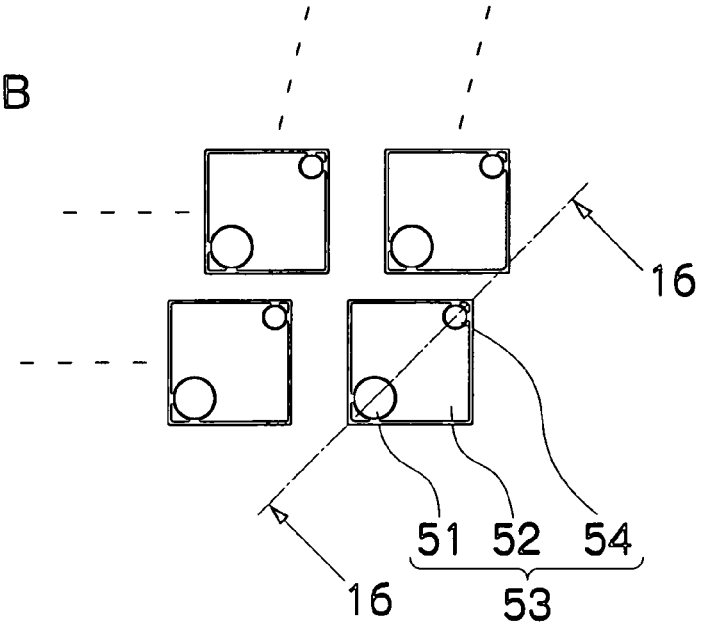
FIG. 15B is an enlarged diagram of a portion of the head.
Figure 16:
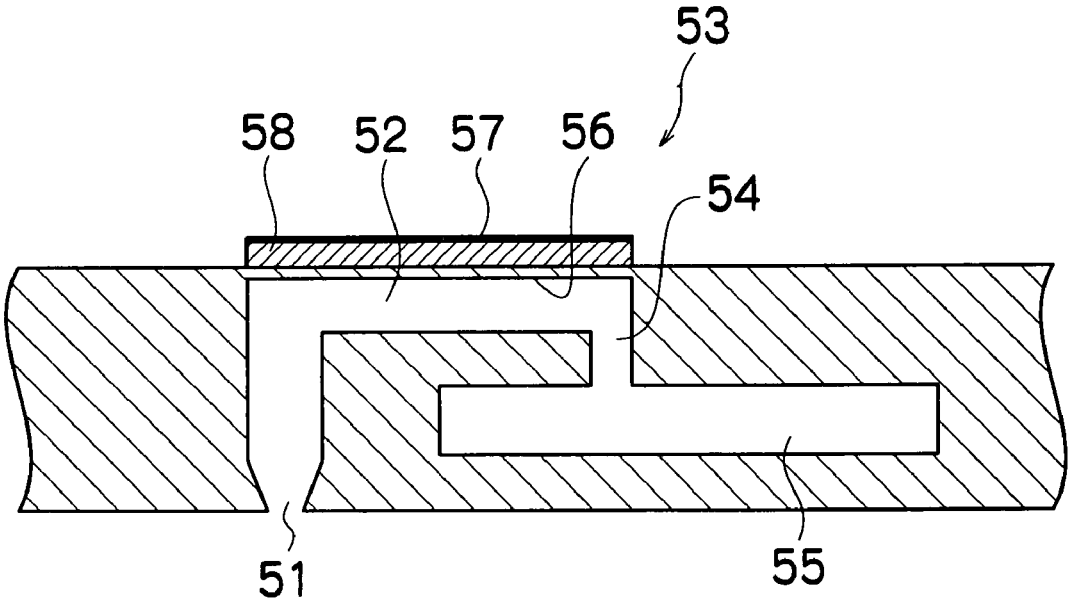
FIG. 16 is a cross-sectional diagram along line 16-16 in FIG. 15A, which shows the three-dimensional composition of one of the liquid droplet ejection elements (an ink chamber unit corresponding to one nozzle)

FIG. 15A is a perspective plan view showing an example of the configuration of the head 50, FIG. 15B is an enlarged view of a portion thereof, FIG. 16 is a cross-sectional view taken along the line 16-16 in FIGS. 15A and 15B, showing the inner structure of a droplet ejection element (an ink chamber unit corresponding to one nozzle 51).

The nozzle pitch in the head 50 is required to be reduced in order to maximize the density of the dots printed on the surface of the recording paper 16. As shown in FIGS. 15A and 15B, the head 50 according to the present embodiment has a structure in which a plurality of ink chamber units (droplet ejection elements) 53, each including a nozzle 51 forming an ink ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

As shown in FIG. 16, each pressure chamber 52 is connected to a common channel 55 through the supply port 54. The common channel 55 is connected to an ink tank (not shown in drawings), which is a base tank that supplies ink, and the ink supplied from the ink tank is delivered through the common flow channel 55 and is then distributed to the pressure chambers 52.

An actuator 58 provided with an individual electrode 57 is bonded to a pressure plate 56 (a diaphragm that also serves as a common electrode) which forms the surface of one portion (the ceiling in FIG. 16) of the pressure chambers 52. When a drive voltage is applied to the individual electrode 57 and the common electrode, the actuator 58 is deformed and the volume of the pressure chamber 52 is thereby changed to generate the pressure change in the pressure chamber 52, so that the ink inside the pressure chamber 52 is thus ejected through the nozzle 51. When the displacement of the actuator 58 returns to its original position after ejecting ink, the pressure chamber 52 is replenished with new ink from the common flow channel 55, via the supply port 54.

Figure 17:
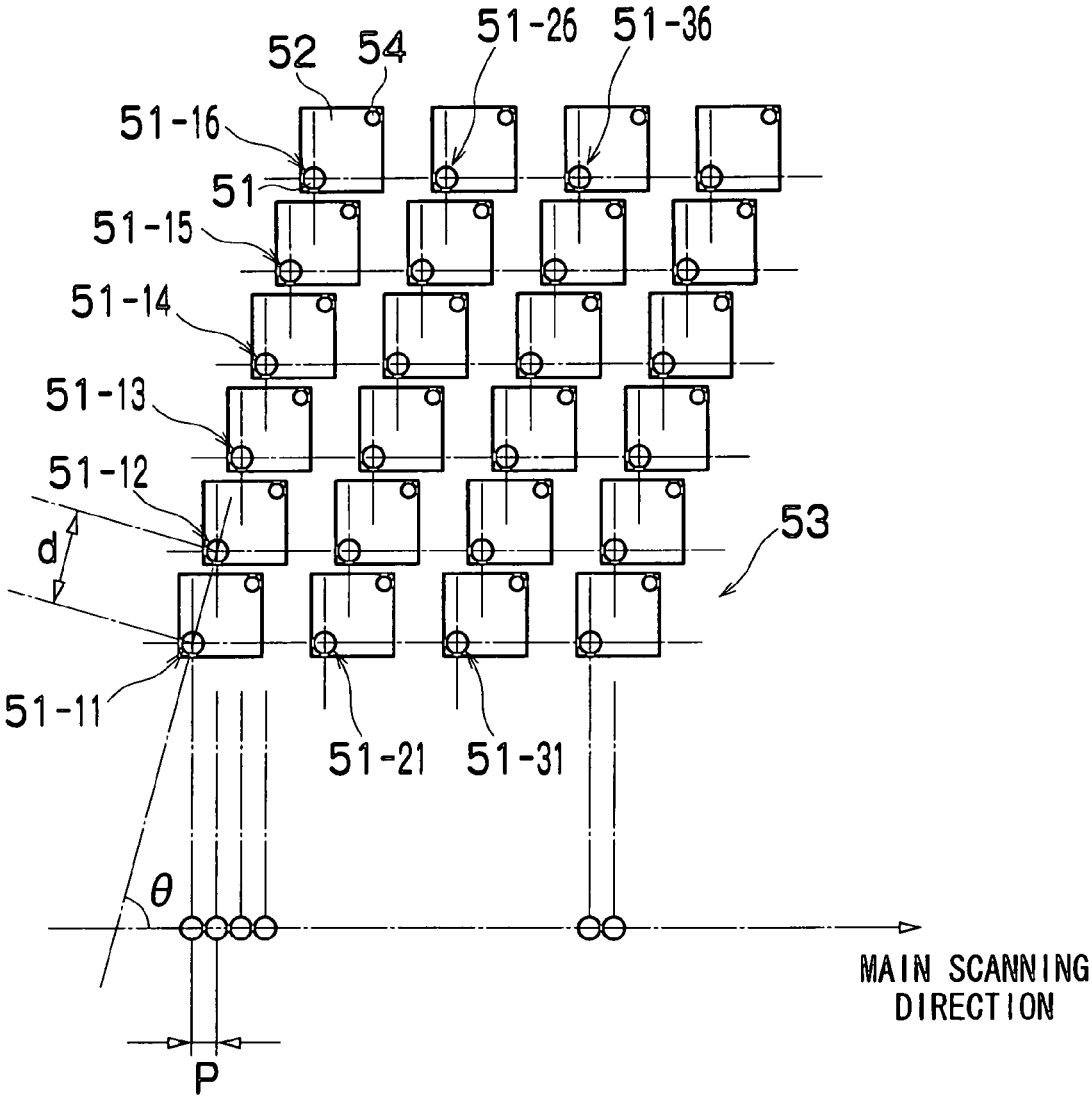
FIG. 17 is an enlarged view showing a nozzle arrangement in the head shown in FIG. 15A.

As shown in FIG. 17, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head including rows of nozzles that have a length corresponding to the entire width of the image recordable width, the "main scanning" is defined as printing one line (a line formed of a row of dots, or a line formed of a plurality of rows of dots) in the width direction of the intermediate transfer body (the direction perpendicular to the conveyance direction of the intermediate transfer body) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

On the other hand, "sub-scanning" is defined as to repeatedly perform printing of one line (a line formed of a row of dots, or a line formed of a plurality of rows of dots) formed by the main scanning, while moving the full-line head and the intermediate transfer body 14 relatively to each other.

The direction indicated by one line (or the lengthwise direction of a band-shaped region) recorded by the main scanning as described above is called the "main scanning direction", and the direction in which the sub-scanning is performed, is called the "sub-scanning direction". In other words, in the present embodiment, the conveyance direction of the intermediate transfer body 14 is called the sub-scanning direction and the direction perpendicular to same is called the main scanning direction.

Description of Control System

Figure 18:
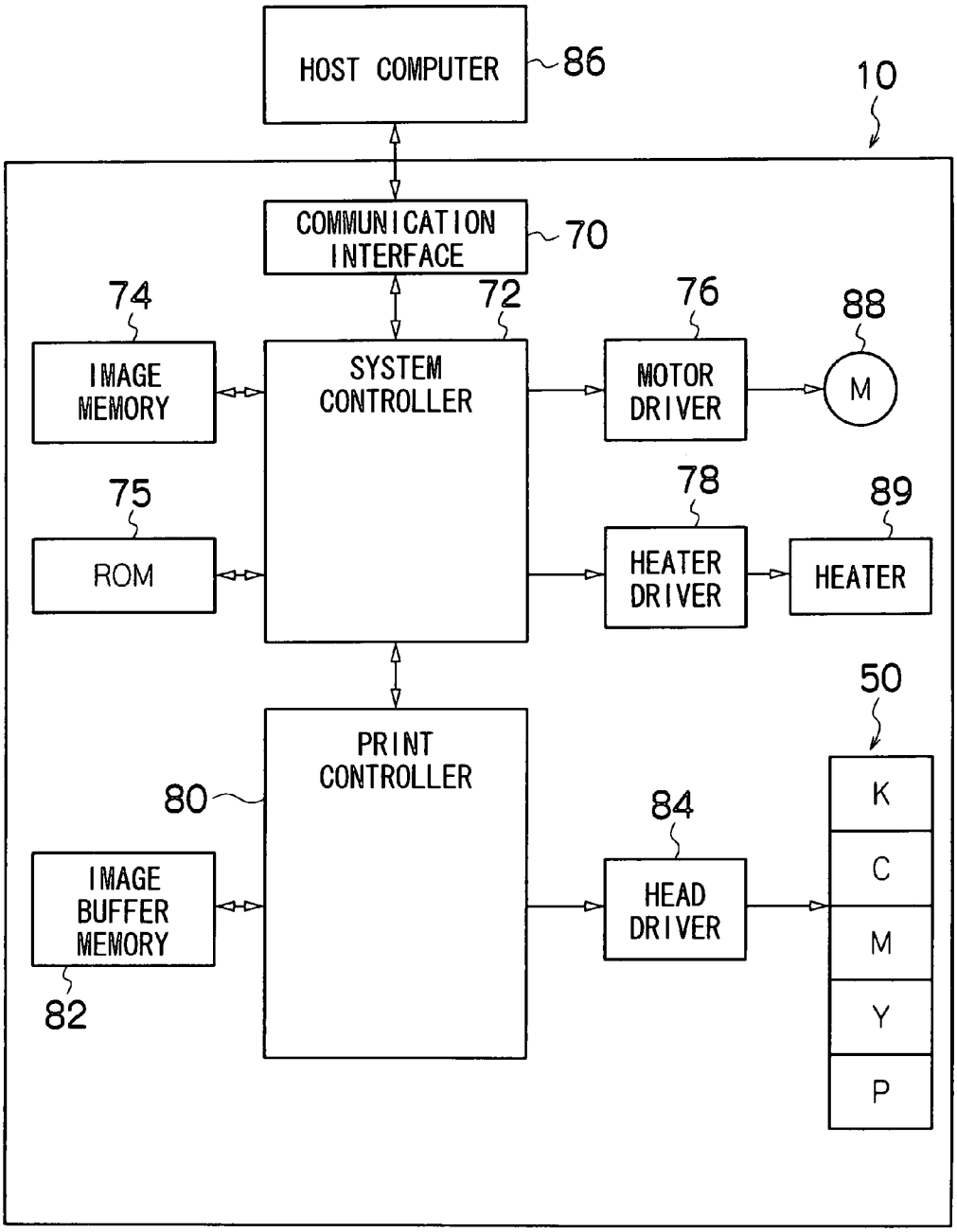
FIG. 18 is a block diagram showing the system composition of an inkjet recording apparatus according to an embodiment of the present invention.

FIG. 18 is a block diagram showing the system configuration of the inkjet recording apparatus 10. As shown in FIG. 18, the inkjet recording apparatus 10 includes a communication interface 70, a system controller 72, an image memory 74, a ROM 75, a motor driver 76, a heater driver 78, a print controller 80, an image buffer memory 82, a head driver 84, and the like.

The communication interface 70 is an interface unit (image input unit) which functions as an image input device for receiving image data transmitted by a host computer 86. The image data sent from the host computer 86 is received by the inkjet recording apparatus 10 through the communication interface 70, and is temporarily stored in the image memory 74. The image memory 74 is a storage device for storing images inputted through the communication interface 70, and data is written and read to and from the image memory 74 through the system controller 72.

The system controller 72 controls the various sections, such as the communication interface 70, the image memory 74, the motor driver 76, the heater driver 78, and the like, as well as controlling communications with the host computer 86 and writing and reading to and from the image memory 74 and ROM 75, and it also generates control signals for controlling the motor 88 and heater 89 of the conveyance system.

The ROM 75 stores a program to be executed by the CPU of the system controller 72, and various data required for control operations (including data for a test pattern for measuring depositing position error), and the like. The image memory 74 is used as a temporary storage region for the image data, and it is also used as a program development region and a calculation work region for the CPU. The motor driver (drive circuit) 76 drives the motor 88 of the conveyance system in accordance with commands from the system controller 72. The heater driver 78 drives the heater 89 of the post-drying unit (not shown in drawings) or the like in accordance with commands from the system controller 72.

The print controller 80 is a control unit which functions as a signal processing device for performing various treatment processes, corrections, and the like, in accordance with the control implemented by the system controller 72, in order to generate a signal for controlling droplet ejection from the image data (multiple-value input image data) in the image memory 74, as well as functioning as a drive control device which controls the ejection driving of the head 50 by supplying the ink ejection data thus generated to the head driver 84.

The print controller 80 is provided with the image buffer memory 82; and image data, parameters, and other data are temporarily stored in the image buffer memory 82 when image data is processed in the print controller 80.

To give a general description of the sequence of processing from image input to print output, image data to be printed is input from an external source via the communication interface 70, and is accumulated in the image memory 74. At this stage, multiple-value RGB image data is stored in the image memory 74, for example.

In other words, the print controller 80 performs processing for converting the input RGB image data into dot data for the four colors of K, C, M and Y. The dot data generated by the print controller 80 in this way is stored in the image buffer memory 82. This dot data of the respective colors is converted into CMYK droplet ejection data for ejecting inks from the nozzles of the head 50, thereby establishing the ink ejection data to be printed.

The head driver 84 outputs a drive signal for driving the actuators 58 corresponding to the nozzles 51 of the head 50 in accordance with the print contents, on the basis of the ink ejection data and the drive waveform signals supplied by the print controller 80.

By supplying the drive signal output from the head driver 84 to the head 50 in this way, ink is ejected from the corresponding nozzles 51. By controlling ink ejection from the heads 50 in synchronization with the conveyance speed of the recording paper 16, an image is formed on the recording paper 16.

As described above, the ejection volume and the ejection timing of the ink droplets from the respective nozzles are controlled via the head driver 84, on the basis of the ink ejection data generated by implementing prescribed signal processing in the print controller 80, and the drive signal waveform. By this means, prescribed dot sizes and dot positions can be achieved.

The image forming apparatus according to the present invention has been described in detail above, but the present invention is not limited to the aforementioned embodiments, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a conveyance device which conveys an ejection receiving medium;

an ejection head which ejects and deposits droplets of liquid on the ejection receiving medium conveyed by the conveyance device, the deposited droplets of the liquid constituting an image on the ejection receiving medium, wherein the following condition is satisfied:

$$\gamma_S \geqq \gamma_L,$$

where $\gamma_S$ is a surface energy of the ejection receiving medium, $\gamma_L$ is a surface energy of the liquid;

and a controller that controls the ejection so that the following conditions are satisfied:

$$d \geqq \sqrt{2} \times l; \text{ and}$$

$$2 \times \gamma_S \times \sqrt{\left(\frac{d}{2}\right)^2 - \left(\frac{l}{2}\right)^2} \geq d \times \gamma_L$$

where d is a diameter of each of the droplets of the liquid deposited on the ejection receiving medium, and l is a maximum of a resolution pitch of the image.

2. The image forming apparatus as defined in claim 1, wherein:

the ejection receiving medium is an intermediate transfer body; and the image formed on the intermediate transfer body is transferred to a recording medium.

3. The image forming apparatus as defined in claim 1, wherein the surface energy $\gamma_S$ of the ejection receiving medium is not less than 20 mN/m and not greater than 50 mN/m.

4. An image forming apparatus comprising:

a conveyance device which conveys an ejection receiving medium;

a first ejection head which ejects and deposits droplets of a first liquid on the ejection receiving medium conveyed by the conveyance device;

a second ejection head which ejects and deposits droplets of a second liquid on the ejection receiving medium on which the first liquid has been deposited, the deposited droplets of the first liquid and the deposited droplets of the second liquid constituting an image on the ejection receiving medium, wherein the following condition is satisfied:

$$\gamma_S \geqq \gamma_{L1},$$

where $\gamma_S$ is a surface energy of the ejection receiving medium, $\gamma_{L1}$ is a surface energy of the first liquid;

and a controller that controls the ejection so that the following conditions are satisfied:

$$d_1 \geqq \sqrt{2} \times l; \text{ and}$$

$$2 \times \gamma_s \times \sqrt{\left(\frac{d_1}{2}\right)^2 - \left(\frac{l}{2}\right)^2} \geq d_1 \times \gamma_{L1}$$

where $d_1$ is a diameter of each of the droplets of the first liquid deposited on the ejection receiving medium, and l is a maximum of a resolution pitch of the image.

5. The image forming apparatus as defined in claim 4, wherein the first liquid enhances recording characteristics of the second liquid.

6. The image forming apparatus as defined in claim 4, wherein:

the ejection receiving medium is an intermediate transfer body; and the image formed on the intermediate transfer body is transferred to a recording medium.

7. The image forming apparatus as defined in claim 4, wherein the surface energy $\gamma_S$ of the ejection receiving medium is not less than 20 mN/m and not greater than 50 mN/m.

8. The image forming apparatus as defined in claim 4, wherein the first liquid contains a solvent-insoluble material which enhances fixing characteristics of the image on the ejection receiving medium.

9. An image forming method of forming an image on an ejection receiving medium, comprising the steps of:

providing liquid to be ejected of which surface energy $\gamma_L$ is not greater than $\gamma_S$ of surface energy of the ejection receiving medium; and ejecting and depositing droplets of the liquid on the ejection receiving medium with controlling the ejection of the liquid so that the following conditions are satisfied while the ejection receiving medium is conveyed, the deposited droplets of the liquid constituting the image on the ejection receiving medium, the conditions are:

$d \geqq \sqrt{2} \times l$; and $$2 \times \gamma_s \times \sqrt{\left(\frac{d}{2}\right)^2 - \left(\frac{l}{2}\right)^2} \geq d \times \gamma_L$$

where d is a diameter of each of the droplets of the liquid deposited on the ejection receiving medium, and l is a maximum of a resolution pitch of the image.

10. An image forming method of forming an image on an ejection receiving medium, comprising the steps of:

providing a first liquid to be ejected of which surface energy $\gamma_{L1}$ is not greater than $\gamma_S$ of surface energy of the ejection receiving medium;

ejecting and depositing droplets of the first liquid on the ejection receiving medium with controlling the ejection of the first liquid so that the following conditions are satisfied while the ejection receiving medium is conveyed; and then ejecting and depositing droplets of a second liquid on the ejection receiving medium while the ejection receiving medium is conveyed, the deposited droplets of the first liquid and the deposited droplets of the second liquid constituting the image on the ejection receiving medium, the conditions are:

$d_1 \geqq \sqrt{2} \times l$; and $$2 \times \gamma_s \times \sqrt{\left(\frac{d_1}{2}\right)^2 - \left(\frac{l}{2}\right)^2} \geq d_1 \times \gamma_{L1}$$

where $d_1$ is a diameter of each of the droplets of the first liquid deposited on the ejection receiving medium, and l is a maximum of a resolution pitch of the image.

* * * * *